US010907857B2

(12) United States Patent
Kajino

(10) Patent No.: US 10,907,857 B2
(45) Date of Patent: Feb. 2, 2021

(54) DEW-CONDENSATION PREVENTING SQUARE DUCT

(71) Applicant: SHINFUJI KUUCHOU CO., LTD., Kounosu (JP)

(72) Inventor: Isamu Kajino, Kounosu (JP)

(73) Assignee: SHINFUJI KUUCHOU CO., LTD., Kounosu (JP)

( * ) Notice: Subject to any disclaimer, the term of this patent is extended or adjusted under 35 U.S.C. 154(b) by 0 days.

(21) Appl. No.: 16/192,647

(22) Filed: Nov. 15, 2018

(65) Prior Publication Data

US 2019/0346172 A1 Nov. 14, 2019

(30) Foreign Application Priority Data

May 11, 2018 (JP) ..... 2018-92064
Oct. 5, 2018 (JP) ..... 2018-189951

(51) Int. Cl.
*F24F 13/02* (2006.01)
*F24F 13/22* (2006.01)

(52) U.S. Cl.
CPC ..... *F24F 13/0281* (2013.01); *F24F 13/0209* (2013.01); *F24F 13/0245* (2013.01); *F24F 13/0263* (2013.01); *F24F 13/22* (2013.01); *F24F 2013/221* (2013.01)

(58) Field of Classification Search
CPC ..... F24F 13/0281; F24F 13/0209; F24F 13/0245; F24F 13/0263; F24F 13/22; F24F 13/221; F24F 2013/221
USPC ..... 138/113
See application file for complete search history.

(56) References Cited

U.S. PATENT DOCUMENTS 6,230,750 B1 * 5/2001 Lessard ..... E04F 17/04 138/149
6,360,783 B2 * 3/2002 Faverio, IV ..... F16L 59/147 138/143
6,547,287 B1 * 4/2003 Shah ..... F16L 9/003 285/364
7,699,078 B1 * 4/2010 Husmann, Jr. ..... F24F 13/0245 138/114
9,114,579 B2 * 8/2015 Lanciaux ..... B29D 23/001
9,371,941 B1 * 6/2016 Faverio, IV ..... F24F 13/0263
2007/0261345 A1 * 11/2007 Janka ..... F24F 13/20 52/404.1

(Continued)

FOREIGN PATENT DOCUMENTS

JP 2008-89288 A 4/2008

*Primary Examiner* — Craig M Schneider
*Assistant Examiner* — David R Deal
(74) *Attorney, Agent, or Firm* — Arent Fox LLP

(57) ABSTRACT

To provide a dew-condensation preventing square duct which is capable preventing dew condensation on the duct without winding a heat insulating material around the duct. A dew-condensation preventing square duct includes: an external square duct formed by four plate-shaped external wall portions and having a substantially quadrilateral barrel shape; an internal square duct formed by four plate-shaped internal wall portions and having a substantially quadrilateral barrel shape, the internal square duct being arranged inside of the external square duct; and a holding protrusion which holds the internal square duct inside of the external square duct such that a heat insulating layer S between the external square duct and the internal square duct has a predetermined thickness T.

15 Claims, 20 Drawing Sheets

(56) References Cited

U.S. PATENT DOCUMENTS

| | | | | |
|---|---|---|---|---|
| 2015/0101697 | A1* | 4/2015 | Duffy | F24F 13/0209<br>138/149 |
| 2016/0215997 | A1* | 7/2016 | Carlyon | B32B 5/20 |
| 2017/0276394 | A1* | 9/2017 | Minter | F24F 13/0281 |
| 2019/0017723 | A1* | 1/2019 | Surraco | F24F 13/0263 |

* cited by examiner

DEW-CONDENSATION PREVENTING SQUARE DUCT

CROSS-REFERENCE TO RELATED APPLICATIONS

This application claims priority from Japanese Patent Application No. 2018-92064, filed on May 11, 2018 and Japanese Patent Application No. 2018-189951 filed Oct. 5, 2018. The entire contents of these applications are incorporated herein by reference.

TECHNICAL FIELD

The present invention relates to a square duct having a substantially quadrilateral shape in section, and particularly, a dew-condensation preventing square duct capable of preventing dew condensation on the duct.

BACKGROUND ART

A duct or the like employed for an air conditioner can be subjected to a process of heat insulation in an installation site for the purpose of preventing dew condensation (e.g., refer to Patent Document 1). Specifically, the duct is installed in a predetermined installation place such as the inside of a ceiling, and thereafter, around the duct, a heat insulating material or the like is wound, for example, the heat insulating material being made of glass wool and having a sheet shape (belt shape). In general, an installation company installs the duct, and another installation company conducts the heat insulation process by carrying the heat insulating material, separately from the duct, into the site and arranging it there.

PRIOR ART DOCUMENT

Patent Document

[Patent Document 1] Japanese Patent Laid-Open Publication No. 2008-089288

SUMMARY OF THE INVENTION

Problems to be solved by the Invention

However, the heat insulation process is conducted with the duct being installed inside of a ceiling or in such another. This makes it hard to execute the work, requires a great deal of labor and time for the work execution, and producing wastes of the heat insulating material in an installation site, thereby requiring the disposal or the like thereof. Particularly in recent years, in a construct site or the like, the construct/work-execution schedule, or the construct/work-execution costs or the like including the disposal expenses or the like have been strictly restricted and controlled. Taking this into account, a pressing need has arisen for conducting the heat insulation process swiftly, preventing any wastes from being produced in an installation site, and the like.

In addition, since a company installing a duct is conventionally different from a company conducting a heat insulation process for the duct, the work-execution schedule cannot be easily coordinated adjusted and can be complicated. Further, a duct and a heat insulating material have to be individually kept in a depository separate from each other, and thereby, in carrying and keeping them, the coordination can complicate. Still further, a large number of workers are needed, thereby increasing the cost and deteriorating the safety.

Therefore, it is an object of the present invention to provide a dew-condensation preventing square duct which is capable of preventing dew condensation on the duct without winding a heat insulating material around the duct.

Means for solving the Problems

In order to accomplish the object, a dew-condensation preventing square duct according to claim 1, comprises: an external square duct formed by four plate-shaped external wall portions and having a substantially quadrilateral barrel shape; an internal square duct formed by four plate-shaped internal wall portions and having a substantially quadrilateral barrel shape, the internal square duct being arranged inside of the external square duct; and a thickness holding portion which holds the internal square duct inside of the external square duct such that a heat insulating layer between the external square duct and the internal square duct has a predetermined thickness.

According to claim 2, the dew-condensation preventing square duct of claim 1 further comprises an axial-direction holding portion holding the internal square duct in the axial directions.

According to claim 3, in the dew-condensation preventing square duct of claim 1 or 2, the thickness holding portion is formed by protruding a part of the external wall portion toward the internal wall portion and bending the part such that the part comes into contact with the internal wall portion, or by protruding a part of the internal wall portion toward the external wall portion and bending the part such that the part comes into contact with the external wall portion.

According to claim 4, in the dew-condensation preventing square duct of claims 1 to 3: an end part of each external wall portion is formed with an external joint portion extending outward substantially perpendicularly to the plate surface of the external wall portion; and an end part of each internal wall portion is formed with an internal joint portion extending substantially parallel to the plate surface of the internal wall portion.

According to claim 5, in the dew-condensation preventing square duct of claim 4: the internal joint portion includes a lower joint portion, a middle joint portion and an upper joint portion, the lower joint portion, the middle joint portion and the upper joint portion being formed by folding in three the end part of the internal wall portion substantially parallel to the plate surface of the internal wall portion and being arranged in order from the side of the internal wall portion, and the free end of the upper joint portion protrudes outward from the bent part of the lower joint portion and the middle joint portion; and the internal square duct is connected to a connected body including the same internal joint portion in structure as the internal joint portion, by fitting the upper joint portion of the internal joint portion of the internal square duct between the upper joint portion and the middle joint portion of the internal joint portion of the connected body, or by fitting the upper joint portion of the internal joint portion of the connected body between the upper joint portion and the middle joint portion of the internal joint portion of the internal square duct.

According to claim 6, in the dew-condensation preventing square duct of claim 5: the upper joint portion of the internal joint portion includes a hooking portion and an upper hooked portion, and the middle joint portion of the internal joint portion includes a middle hooked portion; the upper joint portion of the internal joint portion of the internal square duct is fitted between the upper joint portion and the middle joint portion of the internal joint portion of the connected body, and thereby, the hooking portion of the internal square duct hooks the middle hooked portion of the connected body and the hooking portion of the connected body hooks the upper hooked portion of the internal square duct; and the upper joint portion of the internal joint portion of the connected body is fitted between the upper joint portion and the middle joint portion of the internal joint portion of the internal square duct, and thereby, the hooking portion of the connected body hooks the middle hooked portion of the internal square duct and the hooking portion of the internal square duct hooks the upper hooked portion of the connected body.

According to claim 7, in the dew-condensation preventing square duct of claim 5 or 6: the upper joint portion of the internal joint portion includes a reinforcing rib having a U-shape or inverted U/concave shape in section; and the upper joint portion of the internal joint portion of the internal square duct is fitted between the upper joint portion and the middle joint portion of the internal joint portion of the connected body, or the upper joint portion of the internal joint portion of the connected body is fitted between the upper joint portion and the middle joint portion of the internal joint portion of the internal square duct, and thereby, the reinforcing rib of the internal square duct and the reinforcing rib of the connected body are superposed on top of each other.

According to claim 8, in the dew-condensation preventing square duct of claims 5 to 7, the axial-direction holding portion is formed by protruding the external wall portion toward the internal wall portion and bending the external wall portion such that the axial-direction holding portion comes into contact with the bent part of the upper joint portion and the middle joint portion of the internal joint portion.

According to claim 9, in the dew-condensation preventing square duct of claims 5 to 8, the internal square duct is connected to the connected body, and a joining body is provided which joins the corner parts of the internal joint portions of the internal square duct and the connected body.

According to claim 10, in the dew-condensation preventing square duct of claim 9: the joining body is a substantially L-shaped body and includes a first joining portion having a substantially C-shape in section and extending straight and a second joining portion having a substantially C-shape in section and extending substantially perpendicularly to the first joining portion from an end of the first joining portion, both end parts of the C-shape being freely opened and closed, and the C-shape openings of the first joining portion and the second joining portion are directed to the inside of the L-shape; and the corner parts of the internal joint portions are joined together by: fitting, from an edge of a first superposition portion formed by superposing on top of each other a first internal joint portion equivalent to one of the internal joint portions of the internal square duct and a first internal joint portion equivalent to the internal joint portion of the connected body which has a fitting relation to the former first internal joint portion, the end part of the first superposition portion into the C-shape of the first joining portion; and arranging the second joining portion on the side of an end part of a second superposition portion formed by superposing on top of each other a second internal joint portion equivalent to the internal joint portion adjacent to the first internal joint portion of the internal square duct and a second internal joint portion equivalent to the internal joint portion of the connected body which has a fitting relation to the former second internal joint portion, then closing both end parts of the C-shape, and fitting the end part of the second superposition portion into the C-shape of the second joining portion.

According to claim 11, in the dew-condensation preventing square duct of claims 1 to 3: an end part of each external wall portion is formed with an external joint portion extending outward substantially perpendicularly to the plate surface of the external wall portion; and an end part of each internal wall portion is formed with an internal joint portion extending outward substantially perpendicularly to the plate surface of the internal wall portion and being substantially in the same plane as the external joint portion.

According to claim 12, in the dew-condensation preventing square duct of claim 11: the internal joint portion includes a first internal-wall perpendicular portion formed by bending an end part of the internal wall portion outward substantially perpendicularly to the plate surface of the internal wall portion, and an internal-wall horizontal portion formed by bending the end part of the internal wall portion substantially parallel to the plate surface; and the first internal-wall perpendicular portion is substantially in the same plane as the external joint portion, and the internal-wall horizontal portion comes into contact with the external wall portion and functions as the thickness holding portion.

According to claim 13, in the dew-condensation preventing square duct of claim 11: the external joint portion includes a first external-wall perpendicular portion formed by bending an end part of the external wall portion outward substantially perpendicularly to the plate surface of the external wall portion, and a second external-wall perpendicular portion protruding outward from the first external-wall perpendicular portion on the free-end side of the first external-wall perpendicular portion; the internal joint portion includes a first internal-wall perpendicular portion formed by bending an end part of the internal wall portion outward substantially perpendicularly to the plate surface of the internal wall portion, a second internal-wall perpendicular portion formed by bending the end part of the internal wall portion such that the second internal-wall perpendicular portion is superposed on the first internal-wall perpendicular portion, and an internal-wall horizontal portion formed by bending the end part of the internal wall portion on the free-end side of the second internal-wall perpendicular portion substantially parallel to the plate surface of the internal wall portion; and the second internal-wall perpendicular portion faces the first external-wall perpendicular portion, the first internal-wall perpendicular portion is substantially in the same plane as the second external-wall perpendicular portion, and the internal-wall horizontal portion comes into contact with the external wall portion and functions as the thickness holding portion.

According to claim 14, in the dew-condensation preventing square duct of claim 13, the second internal-wall perpendicular portion comes into contact with the first external-wall perpendicular portion to function as an axial-direction holding portion holding the internal square duct in the axial directions.

According to claim 15, in the dew-condensation preventing square duct of claim 11: the external joint portion includes a first external-wall perpendicular portion formed by bending an end part of the external wall portion outward substantially perpendicularly to the plate surface of the external wall portion, and a second external-wall perpendicular portion protruding outward from the first external-wall perpendicular portion on the free-end side of the first external-wall perpendicular portion; the internal joint portion includes an internal-wall horizontal portion formed by bending an end part of the internal wall portion such that the end part protrudes toward the plate surface of the internal wall portion, a first internal-wall perpendicular portion formed by bending the free end part of the internal joint portion outward from the internal-wall horizontal portion and substantially perpendicularly to the plate surface of the internal wall portion, and a second internal-wall perpendicular portion formed by bending the free end part of the internal joint portion such that the free end part is superposed on the first internal-wall perpendicular portion; and the second internal-wall perpendicular portion faces the first external-wall perpendicular portion, the first internal-wall perpendicular portion is substantially in the same plane as the second external-wall perpendicular portion, and the internal-wall horizontal portion comes into contact with the external wall portion and functions as the thickness holding portion.

According to claim 16, in the dew-condensation preventing square duct of claim 15, the second internal-wall perpendicular portion comes into contact with the first external-wall perpendicular portion to function as an axial-direction holding portion holding the internal square duct in the axial directions.

Advantages of the Invention

In the dew-condensation preventing square duct of claim 1, the heat insulating layer (air layer) having a predetermined thickness is provided between the external square duct and the internal square duct. Because of the heat insulating layer, dew condensation on the dew-condensation preventing square duct can be prevented without winding a heat insulating material around the duct. This dispenses with the labor and time necessary for winding a heat insulating material around the duct, and the disposal or the like of wastes of the heat insulating material. Further, the work-execution schedule, the carriage and keeping of materials for duct installation, and the like, can be easily coordinated. Still further, the number of workers can be reduced, thereby decreasing the cost and enhancing the safety.

In addition, the thickness holding portion enables the heat insulating layer to keep a predetermined thickness, thereby preventing dew condensation on the duct stably over a long period of time.

In the dew-condensation preventing square duct of claim 2, the axial-direction holding portion holds the internal square duct in the axial directions. In other words, the internal square duct is kept unmoved in the axial directions. Therefore, the external square duct and the internal square duct can stably form and hold the heat insulating layer, thereby preventing dew condensation on the duct stably over a long period of time.

In the dew-condensation preventing square duct of claim 3, the thickness holding portion is shaped/formed by protruding a part of the external wall portion toward the internal wall portion and bending the part or by protruding a part of the internal wall portion toward the external wall portion and bending the part. The simple structure makes it possible to produce the thickness holding portion easily at a low cost and keep the heat insulating layer at a predetermined thickness stably over a long period of time.

In the dew-condensation preventing square duct of claim 4, an end part of each external wall portion is formed with an external joint portion extending outward substantially perpendicularly and an end part of each internal wall portion is formed with an internal joint portion extending substantially parallel to the plate surface of the internal wall portion. In other words, the external joint portion is not parallel to the internal joint portion, and the former is substantially perpendicular to the latter. This arrangement prevents the external joint portion and the internal joint portion from interfering with each other, thereby facilitating conducting the joint work securely. Further, the internal joint portions are first connected to each other, and the tentative connection enables the external joint portions to be easily and flexibly connected to each other.

In the dew-condensation preventing square duct of claim 5, the upper joint portion of the internal joint portion of the internal square duct is fitted between the upper joint portion and the middle joint portion of the internal joint portion of the connected body, or the upper joint portion of the internal joint portion of the connected body is fitted between the upper joint portion and the middle joint portion of the internal joint portion of the internal square duct. This fitting is simply conducted to connect the internal square duct to the connected body. Therefore, the internal square duct can be connected easily and within a short time to the connected body. Further, even in a narrow space, a high position or the like, a worker can make the connection appropriately without a heavy burden. Still further, the worker does not have to use any tool, thereby making the work safer and easier.

In addition, among the four internal joint portions of the internal square duct, the upper joint portion of one internal joint portion may be fitted between the upper joint portion and the middle joint portion of the internal joint portion of the connected body, or the upper joint portion of the internal joint portion of the connected body may be fitted between the upper joint portion and the middle joint portion of another internal joint portion. In other words, a worker can conduct the fitting, regardless of which of the upper joint portions of the internal square duct and the connected body should be fitted. Hence, the worker does not have to pay attention to the upper joint portion to be fitted, so that the worker can make the connection more easily and within a shorter time.

In the dew-condensation preventing square duct of claim 6, the internal square duct is connected to the connected body, and thereby, the hooking portion of the internal square duct hooks the middle hooked portion of the connected body and the hooking portion of the connected body hooks the upper hooked portion of the internal square duct, or the hooking portion of the connected body hooks the middle hooked portion of the internal square duct and the hooking portion of the internal square duct hooks the upper hooked portion of the connected body. This prevents and restrains the internal square duct and the connected body from disconnecting, and hence, the connection becomes appropriate and strong.

In the dew-condensation preventing square duct of claim 7, the internal joint portions of the internal square duct and the connected body are individually formed with a reinforcing rib. Therefore, the internal joint portions strengthen, and thereby, the internal square duct can be appropriately and strongly connected to the connected body. Further, the internal square duct and the connected body connect each other, and thereby, the reinforcing rib of the internal square duct and the reinforcing rib of the connected body are superposed on each other. This makes the connection more appropriate and stronger.

In the dew-condensation preventing square duct of claim 8, the axial-direction holding portion is shaped/formed by protruding the external wall portion toward the internal wall portion and bending the external wall portion such that the axial-direction holding portion comes into contact with the bent part of the upper joint portion and the middle joint portion of the internal joint portion. The simple structure is created by bending the external wall portion and simply utilizing the bent part of the internal joint portion. Hence, the axial-direction holding portion can be produced easily at a low cost and can hold the internal square duct stably over a long period of time.

In the dew-condensation preventing square duct of claim 9, the internal square duct is connected to the connected body, and a joining body joins the corner parts of the internal joint portions of the internal square duct and the connected body. Therefore, the connection of the internal square duct and the connected body can be strongly maintained.

In the dew-condensation preventing square duct of claim 10, the end part of the first superposition portion of the internal square duct and the connected body is fitted into the C-shape of the first joining portion of the joining body. Next, the second joining portion of the joining body is arranged on the side of the end part of the second superposition portion of the internal square duct and the connected body, then both end parts of the C-shape are closed and the end part of the second superposition portion is fitted into the C-shape. The simple process is only conducted, and thereby, the corner parts of the internal joint portions can be easily and appropriately joined together. Further, a worker does not have to use any tool, thereby making the work safer and easier.

In the dew-condensation preventing square duct of claim 11, an end part of each external wall portion is formed with an external joint portion extending outward substantially perpendicularly, and an end part of each internal wall portion is formed with an internal joint portion extending outward substantially perpendicularly and being substantially in the same plane as the external joint portion. Therefore, the external joint portion and the internal joint portion are individually subjected to the corresponding joint process (connection work) simultaneously in the same plane. In other words, if the external joint portion is subjected to the joint process, then at the same time, the internal joint portion will also be subjected to the joint process. This makes it possible to reduce the time and lighten the labor. Further, the internal joint portion does not protrude from the external joint portion, so that a worker can carry and handle the duct more easily and safely.

In the dew-condensation preventing square duct of claim 12, the end part of the internal wall portion is bent outward substantially perpendicularly and then is bent substantially parallel, to shape/form a first internal-wall perpendicular portion and an internal-wall horizontal portion (thickness holding portion). The simple structure makes it possible to produce them easily at a low cost and keep the heat insulating layer at a predetermined thickness stably over a long period of time.

In the dew-condensation preventing square duct of claim 13, the second internal-wall perpendicular portion faces the first external-wall perpendicular portion, the first internal-wall perpendicular portion is substantially in the same plane as the second external-wall perpendicular portion. Specifically, the first external-wall perpendicular portion and the second external-wall perpendicular portion forms a stepped part, and the stepped part houses the first internal-wall perpendicular portion and the second internal-wall perpendicular portion. Hence, the first internal-wall perpendicular portion is substantially in the same plane as the second external-wall perpendicular portion to unite the external joint portion and the internal joint portion. As a result, if the external joint portion is subjected to the joint process, then at the same time, the internal joint portion will also be strongly subjected to the joint process.

In addition, in order to prevent a leak (air leak), sealing can be conducted for the bent part of the first internal-wall perpendicular portion and the second internal-wall perpendicular portion which corresponds to the boundary between the external joint portion and the internal joint portion. The bent part is substantially in the same plane as the second external-wall perpendicular portion and hence can be easily and appropriately sealed together with the second external-wall perpendicular portion. Further, the internal-wall horizontal portion has a simple structure formed only by bending the end part of the internal wall portion substantially parallel and functions as the thickness holding portion. The simple structure makes it possible to produce the internal-wall horizontal portion easily at a low cost and keep the heat insulating layer at a predetermined thickness stably over a long period of time.

In the dew-condensation preventing square duct of claim 14, the second internal-wall perpendicular portion comes into contact with the first external-wall perpendicular portion to function as the axial-direction holding portion. The simple formation makes it possible to produce the axial-direction holding portion easily at a low cost and hold the internal square duct stably over a long period of time.

The dew-condensation preventing square duct of claim 15 has the same advantages as claim 13. Further, the free end part of the internal joint portion includes the first internal-wall perpendicular portion and the second internal-wall perpendicular portion which are arranged outside from the internal-wall parallel portion. Hence, the internal joint portion can be easily and appropriately formed.

The dew-condensation preventing square duct of claim 16 has the same advantages as claim 14.

MODE FOR CARRYING OUT THE INVENTION

Embodiments of the present invention will be below described with reference to the drawings.

First Embodiment

Figure 1:
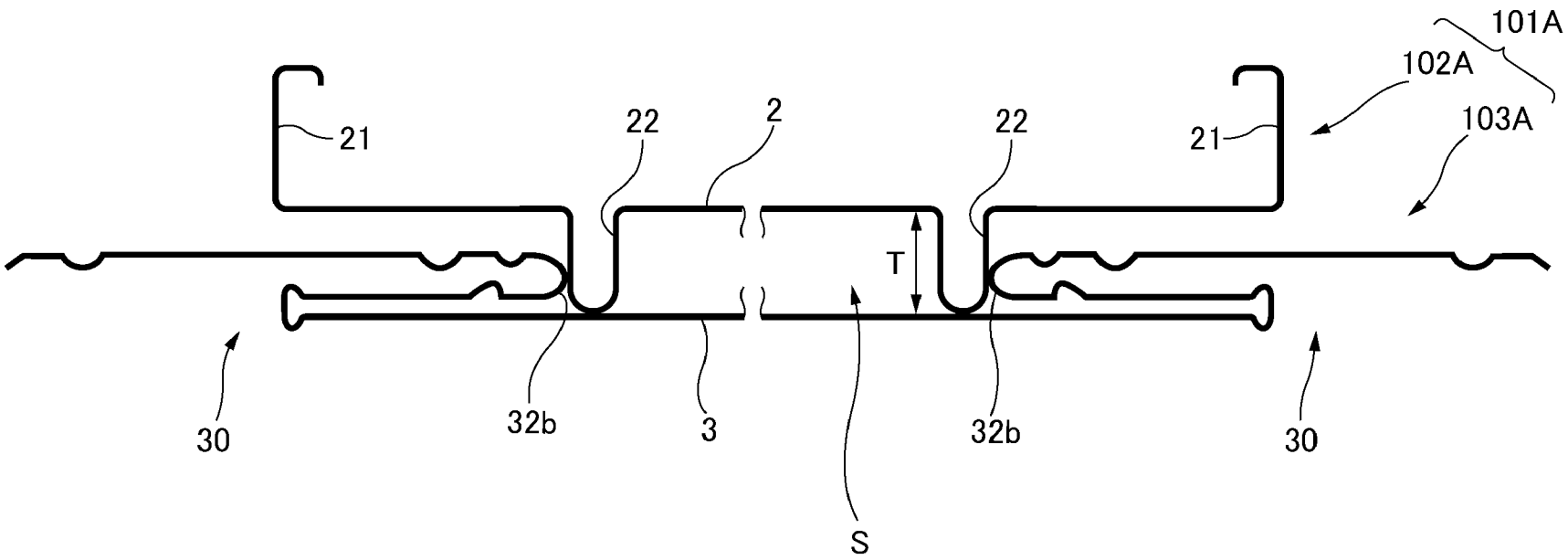
FIG. 1 is a sectional view (along the D-D line of FIG. 2) showing an arrangement relation between an external wall portion and an internal wall portion of a dew-condensation preventing square duct according to a first embodiment of the present invention.
Figure 2:
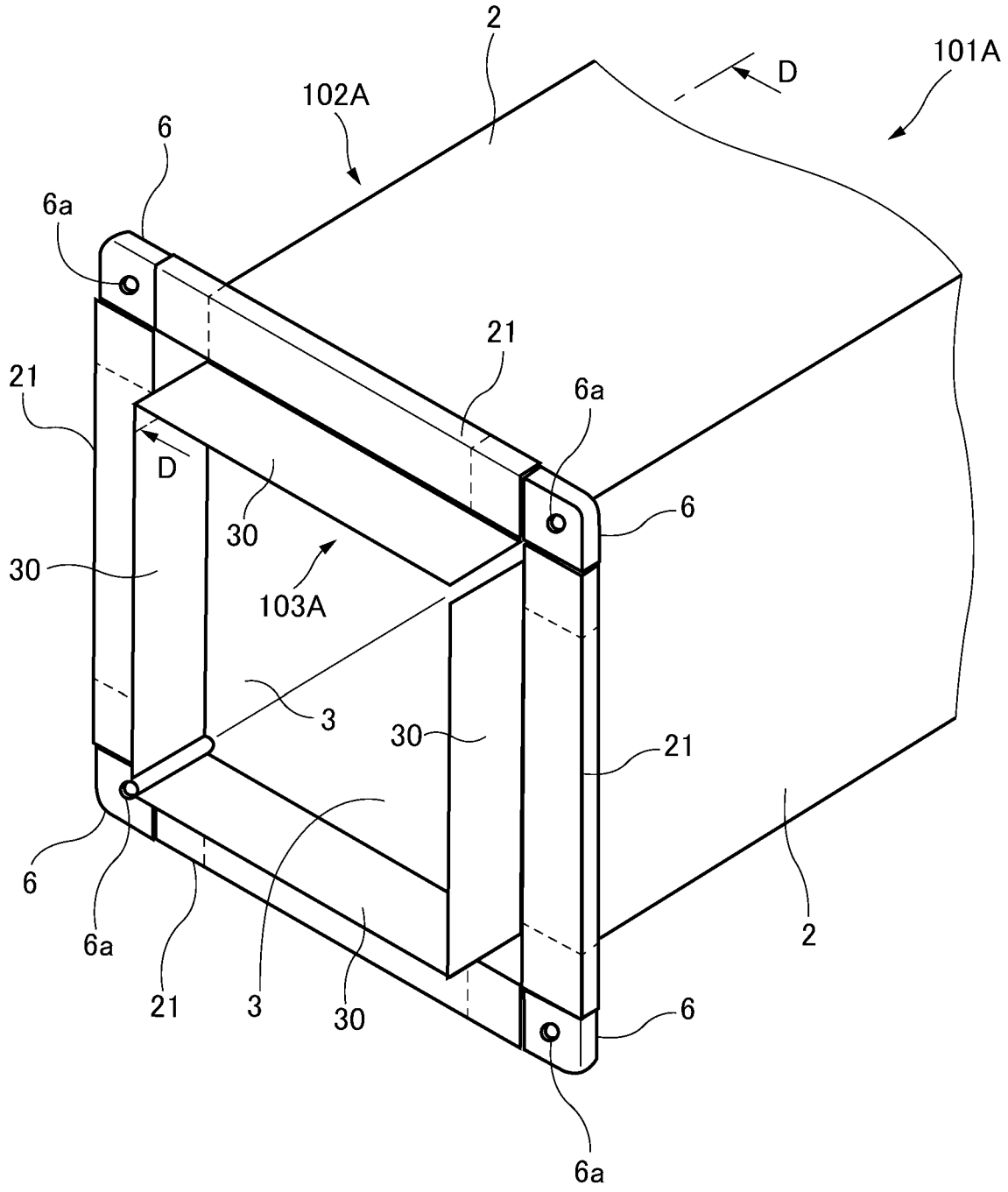
FIG. 2 is a perspective view of the dew-condensation preventing square duct according to the first embodiment.
Figure 3B:
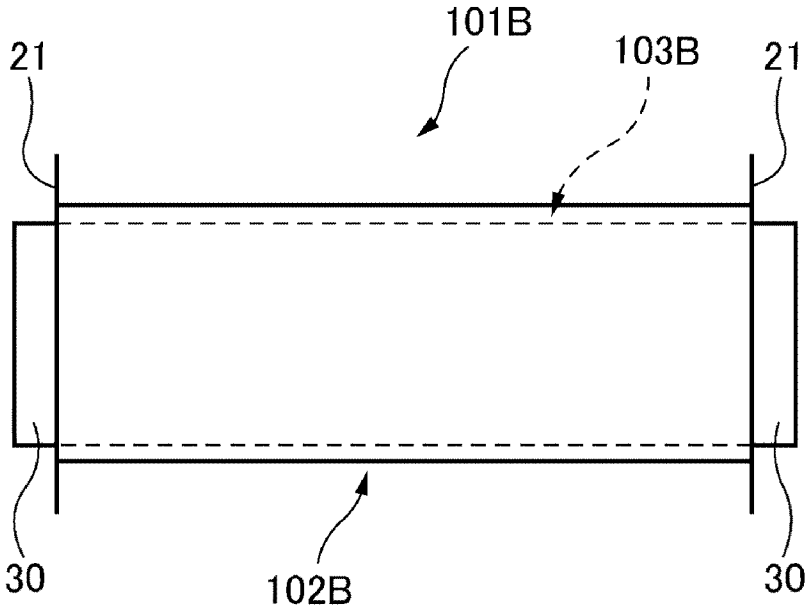
FIGS. 3A and 3B show front views of the dew-condensation preventing square ducts of FIG. 2 before being connected to each other.
Figure 3A:
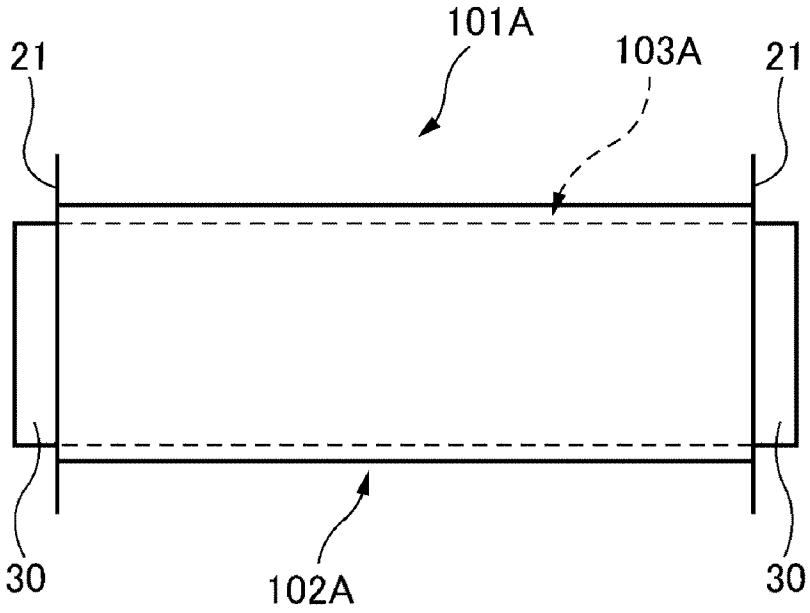

FIGS. 1 to 10 show a first embodiment of the present invention. FIG. 2 is a perspective view of a dew-condensation preventing square duct 101A according to the embodiment. The dew-condensation preventing square duct 101A is capable of preventing dew condensation thereon and has a double-pipe structure formed by an external square duct 102A and an internal square duct 103A arranged inside of the external square duct 102A. The embodiment will be mainly described in the case where, as shown in FIGS. 3A and 3B, the connected body to be connected to the dew-condensation preventing square duct 101A is a dew-condensation preventing square duct 101B having the same structure as the dew-condensation preventing square duct 101A (but both members may differ in the length from each other). Hence, the dew-condensation preventing square duct 101A will be mainly described. The component elements of the dew-condensation preventing square duct 101B are given the same reference numerals and characters as those of the dew-condensation preventing square duct 101A, as long as the former are identical to the latter. Thus, their description is omitted.

Figure 9:
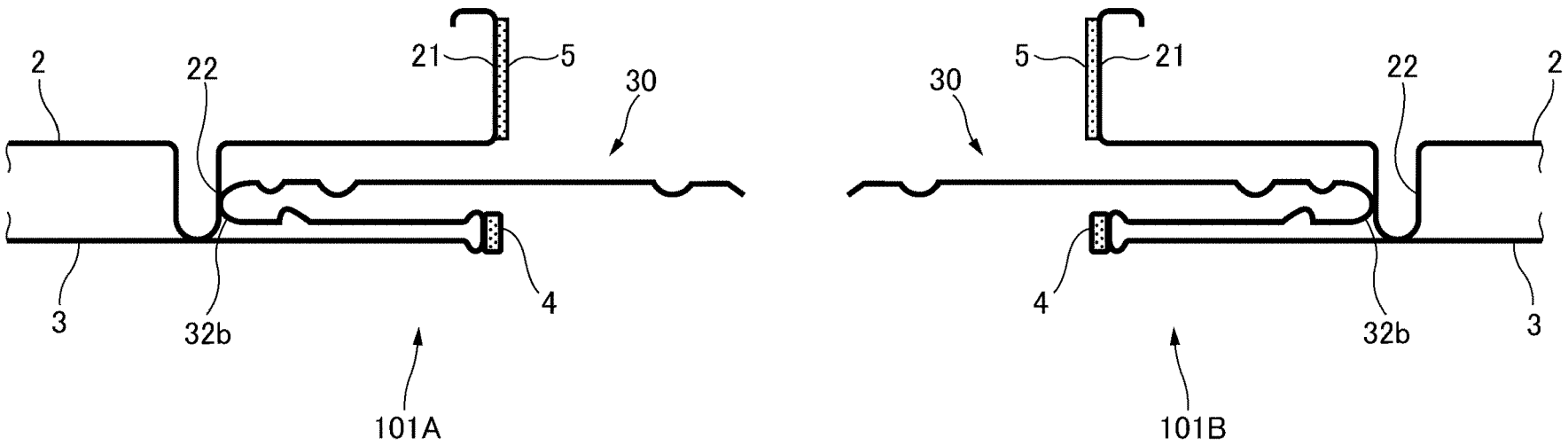
FIG. 9 is a sectional view of the external joint portion and the internal joint portion of the dew-condensation preventing square duct of FIG. 2, showing the facing joint portions of a pair of the ducts being unconnected.

The external square duct 102A is formed by four plate-shaped external wall portions 2 and has a substantially quadrilateral barrel shape. The external wall portion 2 is a corrosion-resisting steel plate. The four external wall portions 2 are each formed with seams or the like running along both side edges in the axial directions and thereby are joined together. Both end parts of each external wall portion 2 in the axial directions are individually formed with an external joint portion 21 for the purpose of the connection to the connected body. In other words, the external joint portion 21 is formed by bending the end part of the external wall portion 2 substantially perpendicularly to form a part of a common-plate flange. The external joint portion 21 extends outward (outside of the barrel shape) from and substantially perpendicularly to the plate surface (the plane forming a part of the barrel shape, the main surface) of the external wall portion 2. As shown in FIG. 2, a corner piece 6 is provided in each of the four corners where the external joint portions 21 are adjacent to each other. The corner piece 6 is an L-shaped flat plate, and the corner part thereof is formed with a bolt hole 6*a*. To the outer surface (joint surface) of each external joint portion 21, as shown in FIG. 9, belt-shaped packing (gasket) 5 is attached for the purpose of making the connection airtight.

The external wall portion 2 is formed on the side of the external joint portion 21, as shown in FIG. 1, with a holding protrusion 22. The holding protrusion 22 has a rib shape formed by bending a part of the external wall portion 2 such that the part protrudes toward an internal wall portion 3. The holding protrusion 22 comes into contact with the internal wall portion 3 and also comes into contact with a bent part 32*b* of an upper joint portion and a middle joint portion 32 of an internal joint portion 30 described later. Therefore, a heat insulating layer S corresponding to the air layer between the external square duct 102A and the internal square duct 103A (the external wall portion 2 and the internal wall portion 3) is designed to have a predetermined thickness T. In this state, the internal square duct 103A is held inside of the external square duct 102A and is held (kept unmoved) in the axial directions. As a result, the holding protrusion is supposed to include both the thickness holding portion and the axial-direction holding portion. The predetermined thickness T of the heat insulating layer S is set to a thickness at which even if the dew-condensation preventing square duct 101A has a large difference in temperature between the inside and the outside, then the heat insulating effect of the heat insulating layer S will prevent dew condensation.

The internal square duct 103A is formed by the four plate-shaped internal wall portions 3 and has a substantially quadrilateral barrel shape. The internal wall portion 3 is a corrosion-resisting steel plate. Both end parts of each internal wall portion 3 in the axial directions are individually formed with the internal joint portion 30 for the purpose of the connection to the connected body. The external square duct 102A and the internal square duct 103A are individually designed to have a sectional shape in which the heat insulating layer S having the predetermined thickness T is formed between the external wall portion 2 and the internal wall portion 3.

Figure 4:
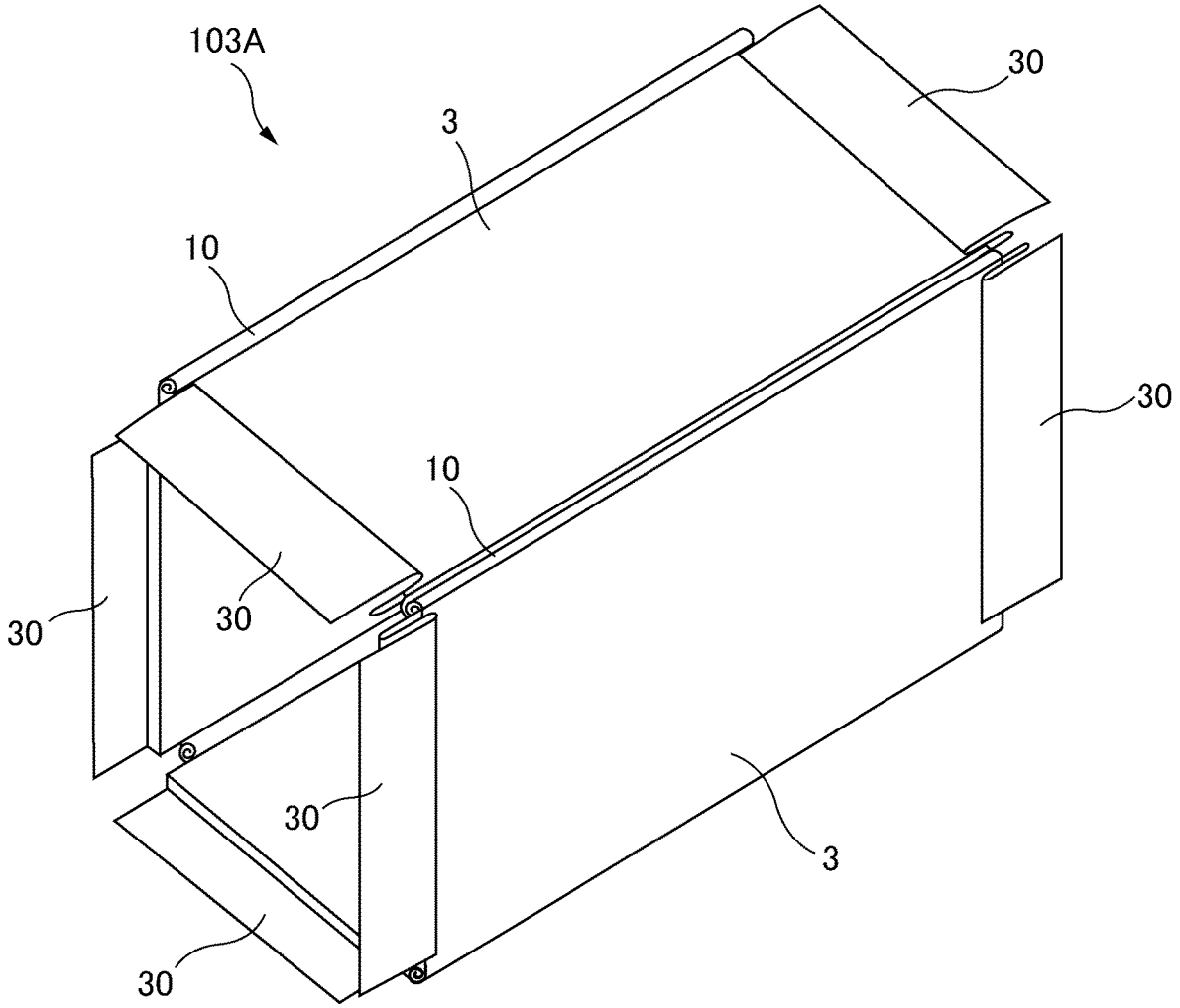
FIG. 4 is a perspective view of an internal square duct of the dew-condensation preventing square duct of FIG. 2.
Figure 5A:
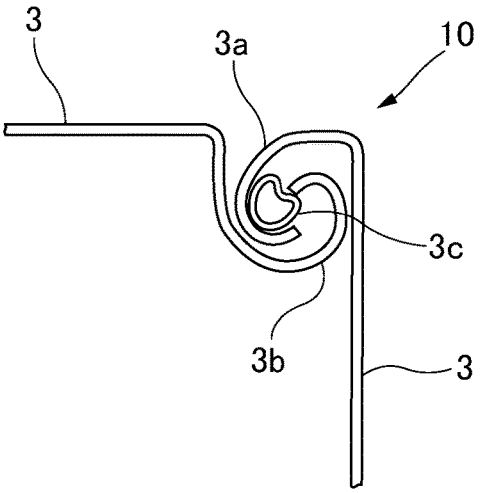
FIGS. 5A and 5B are sectional views of the joining portion of the internal square ducts of FIG. 4, FIG. 5A showing the square ducts being opened and FIG. 5B showing the internal square ducts being closed.
Figure 5B:
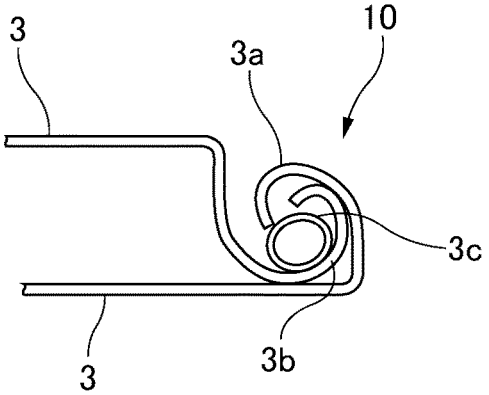

In the embodiment, the internal square duct 103A can be freely folded and unfolded. Specifically, as shown in FIG. 4, the mutually-adjacent internal wall portions 3 are joined together along the side edge parts, and a joining portion 10 thereof can be freely turned. If the joining portion 10 is turned, then the internal wall portions 3 as a whole are folded and superposed on top of each other, or are unfolded so as to form a part of the barrel shape. Specifically, as shown in FIGS. 5A and 5B, the internal wall portion 3 is formed with a curled single seam 3*a*. The single seam 3*a* is located in a side edge part extending in the longitudinal directions of the substantially-rectangular internal wall portion 3 (in the axial directions of the internal square duct 103A). On the other hand, the internal wall portion 3 adjacent to the above internal wall portion 3 is formed with a curled double seam 3*b* engaging with the single seam 3*a*. The double seam 3*b* is located in a side edge part extending in the longitudinal directions of the internal wall portion 3. The single seam 3*a* and the double seam 3*b* form the joining portion (spinning seam) 10.

Figure 6:
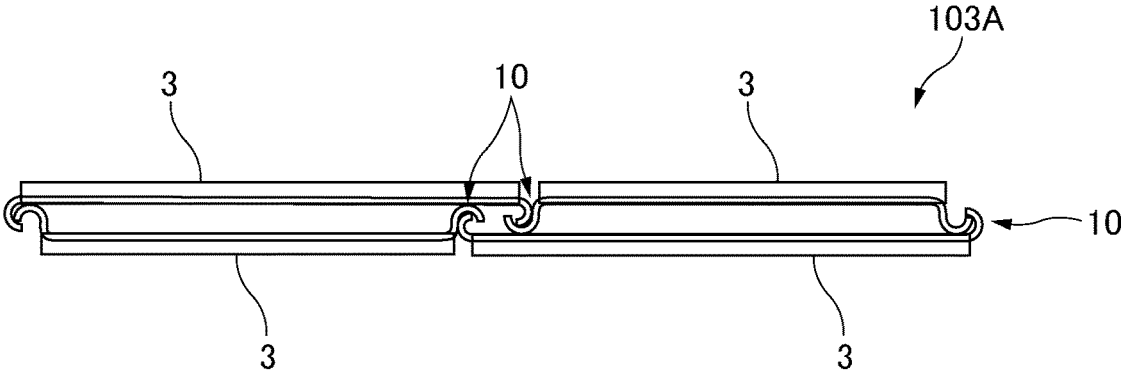
FIG. 6 is a sectional view of the folded internal square ducts of FIG. 4.

When the one internal wall portion 3 and the other internal wall portion 3 are perpendicular to each other (unfolded in the barrel shape shown in FIG. 5A), the one internal wall portion 3 is pressed toward the other internal wall portion 3, and thereby, the single seam 3*a* turns on the double seam 3*b* as the turning axis. As a result, as shown in FIG. 5B, the one internal wall portion 3 moves up to the other internal wall portion 3, and as shown in FIG. 6, both internal wall portions 3 as a whole are folded (flattened) and superposed on top of each other. In the state, if the one internal wall portion 3 is separated from the other internal wall portion 3, then the single seam 3*a* turns on the double seam 3*b* as the turning axis. These internal wall portions 3 are unfolded to form a part of the barrel shape of the four internal wall portions 3. In FIGS. 5A and 5B, a reference numeral and character 3*c* denotes a tube-shaped gasket.

Figure 7:
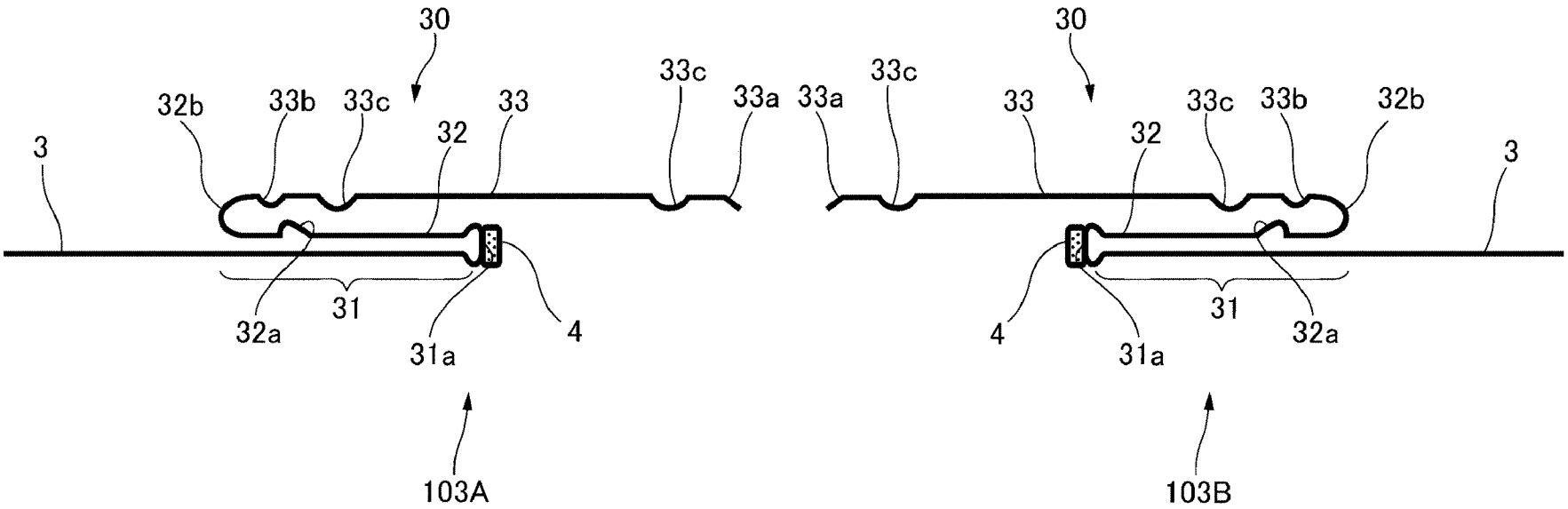
FIG. 7 is a sectional view of internal joint portions of the internal square ducts of FIG. 4.

The internal joint portion 30 extends substantially parallel to the plate surface (the plane forming a part of the barrel shape, the main surface) of the internal wall portion 3. As shown in FIG. 7, the end part of the internal wall portion 3 is folded in three substantially parallel to the plate surface of the internal wall portion 3, and thereby, a lower joint portion 31, a middle joint portion 32 and an upper joint portion 33 are formed in order from the side of the internal wall portion 3. In other words, the lower joint portion 31 is formed such that the end part of the internal wall portion 3 extends directly straight, and the middle joint portion 32 is formed by bending the end part of the internal wall portion 3 such that it is superposed on the lower joint portion 31. The upper joint portion 33 is formed by bending the end part such that it is superposed on the middle joint portion 32. The internal wall portions 3 are each arranged such that the front end part of internal joint portion 30 (the free end part of the upper joint portion 33) protrudes from the corresponding end part (external joint portion 21) of the external square duct 102A.

The free end part of the upper joint portion 33 protrudes and extends from a bent part 31*a* of the lower joint portion 31 and the middle joint portion 32. The protrusion length of the upper joint portion 33 is designed such that when the internal square duct 103A is connected to the internal square duct 103B, the upper joint portion 33 almost covers the lower joint portion 31 and the middle joint portion 32 of the internal square ducts 103B.

The upper joint portion 33 of the internal joint portion 30 of the internal square duct 103A is fitted between the upper joint portion 33 and the middle joint portion 32 of the internal joint portion 30 of the internal square duct 103B. Or alternatively, the upper joint portion 33 of the internal joint portion 30 of the internal square duct 103B is fitted between the upper joint portion 33 and the middle joint portion 32 of the internal joint portion 30 of the internal square duct 103A. The gap or the like enabling the fitting is determined between the upper joint portion 33 and the middle joint portion 32, so that the internal square duct 103A can be connected/joined to the internal square duct 103B.

To the bent part 31*a* of the lower joint portion and the middle joint portion 32, packing 4 for the purpose of making the connection airtight is attached along the longitudinal directions (the edge) of the bent part 31*a*. In order to widen the attachment area of the packing 4, the bent part 31*a* has a trapezoidal shape in section so that the packing 4 having a predetermined width can be attached.

Figure 8:
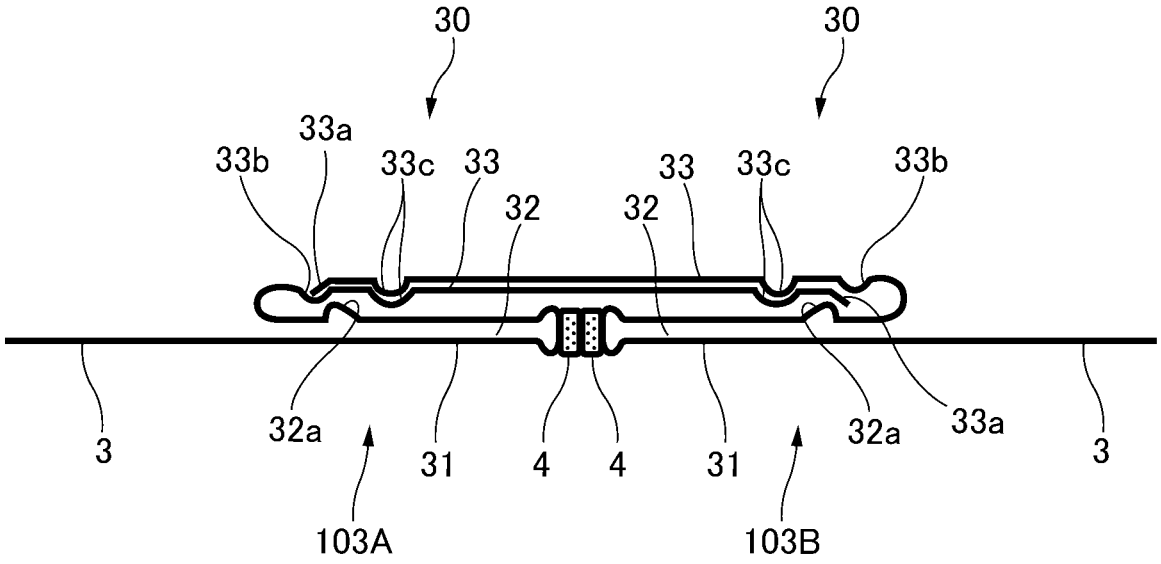
FIG. 8 is a sectional view (along the D1-D1 line of FIG. 15) of the connected internal joint portions of FIG. 7.

As shown in FIG. 8, the upper joint portion 33 of the internal joint portion 30 of the internal square duct 103A is fitted between the upper joint portion 33 and the middle joint portion 32 of the internal joint portion 30 of the internal square duct 103B. Or alternatively, the upper joint portion 33 of the internal joint portion 30 of the internal square duct 103B is fitted between the upper joint portion 33 and the middle joint portion 32 of the internal joint portion 30 of the internal square duct 103A. In the case, the packing 4 of the internal square duct 103A is in contact with the packing 4 of the internal square duct 103B. The thickness of the packing 4, the position of the bent part 31*a* or the like is determined so that the contact can be made. In making the contact, both pieces of the packing 4 are compresses, thereby making the contact more airtight.

The upper joint portion 33 of the internal joint portion 30 includes a hooking portion 33*a* and an upper hooked portion 33*b*, and the middle joint portion 32 of the internal joint portion 30 includes a middle hooked portion 32*a*. Specifically, as shown in FIG. 7, the hooking portion 33*a* is formed in the free end part of the upper joint portion 33. The hooking portion 33*a* is obliquely bent toward the internal wall portion 3 and runs along the free edge of the upper joint portion 33. The upper hooked portion 33*b* is formed in a part of the upper joint portion 33 located on the side of the bent part 32*b* of the upper joint portion 33 and the middle joint portion 32. The upper hooked portion 33*b* has a concave shape depressed toward the internal wall portion 3 and runs along the longitudinal directions (the opening edge of the internal square duct 103A) of the upper joint portion 33. The middle hooked portion 32*a* is formed along the longitudinal directions on the side of the bent part 32*b* of the middle joint portion 32 and has a convex shape protruding toward the opposite side to the internal wall portion 3. The middle hooked portion 32*a* is shaped like a substantially triangle (substantially right-angled triangle: the hypotenuse is positioned on the side where the hooking portion 33*a* comes closer to the middle hooked portion 32*a*). This shape facilitates bringing the hooking portion 33*a* into the middle hooked portion 32*a* and enabling it to appropriately hook the middle hooked portion 32*a*.

Then, the upper joint portion 33 of the internal joint portion 30 of the internal square duct 103A is fitted between the upper joint portion 33 and the middle joint portion 32 of the internal joint portion 30 of the internal square duct 103B, and thereby, as shown in FIG. 8, the hooking portion 33*a* of the internal square duct 103A hooks the middle hooked portion 32*a* of the internal square duct 103B and the hooking portion 33*a* of the internal square duct 103B hooks the upper hooked portion 33*b* of the internal square duct 103A. On the other hand, the upper joint portion 33 of the internal joint portion 30 of the internal square duct 103B is fitted between the upper joint portion 33 and the middle joint portion 32 of the internal joint portion 30 of the internal square duct 103A, and thereby, the hooking portion 33*a* of the internal square duct 103B hooks the middle hooked portion 32*a* of the internal square duct 103A and the hooking portion 33*a* of the internal square duct 103A hooks the upper hooked portion 33*b* of the internal square duct 103B. In other words, in order to realize the above hooking, the hooking portion 33*a*, the upper hooked portion 33*b* and the middle hooked portion 32*a* are individually designed to have a suitable position, shape or the like.

Then, the upper joint portion 33 of the internal joint portion 30 includes a reinforcing rib 33*c* having a U-shape in section, thereby enhancing the strength and flatness. Specifically, as shown in FIG. 7, on each side of the hooking portion 33*a* and the upper hooked portion 33*b* of the upper joint portion 33, the reinforcing rib 33*c* having the U-shaped section depressed toward the internal wall portion 3 is formed along the longitudinal directions.

As shown in FIG. 8, the upper joint portion 33 of the internal joint portion 30 of the internal square duct 103A is fitted between the upper joint portion 33 and the middle joint portion 32 of the internal joint portion 30 of the internal square duct 103B. Or alternatively, the upper joint portion 33 of the internal joint portion 30 of the internal square duct 103B is fitted between the upper joint portion 33 and the middle joint portion 32 of the internal joint portion 30 of the internal square duct 103A. The above fitting enables the reinforcing rib 33*c* of the internal square duct 103A and the reinforcing rib 33*c* of the internal square duct 103B to be superposed on top of each other. In order to realize the superposition, the hooking portion 33*a*, the reinforcing ribs 33*c* are individually designed to have a suitable position, shape or the like. In other words, the shape and size of each reinforcing rib 33*c* are designed to obtain a specified reinforcing effect and flatness retaining effect and to superpose the reinforcing ribs 33*c* of the mutually-fitted internal square ducts 103A and 103B on top of each other.

Next, a description will be given of how to assemble the thus-configured dew-condensation preventing square duct 101A and how to connect it to the dew-condensation preventing square duct 101B.

First, in order to assemble the dew-condensation preventing square duct 101A, the internal square duct 103A is unfolded to form a barrel shape. Then, as shown in FIG. 1, the external wall portions 2 are each placed so as to face the internal wall portion 3, and the holding protrusions 22 are brought into contact with the internal wall portion 3 and also brought into contact with the bent part 32*b*. In this state, the four external wall portions 2 are joined to form the external square duct 102A. As a result, the internal square duct 103A is arranged inside of the external square duct 102A, and the heat insulating layer S having the predetermined thickness T is formed between the external square duct 102A and the internal square duct 103A.

Figure 10:
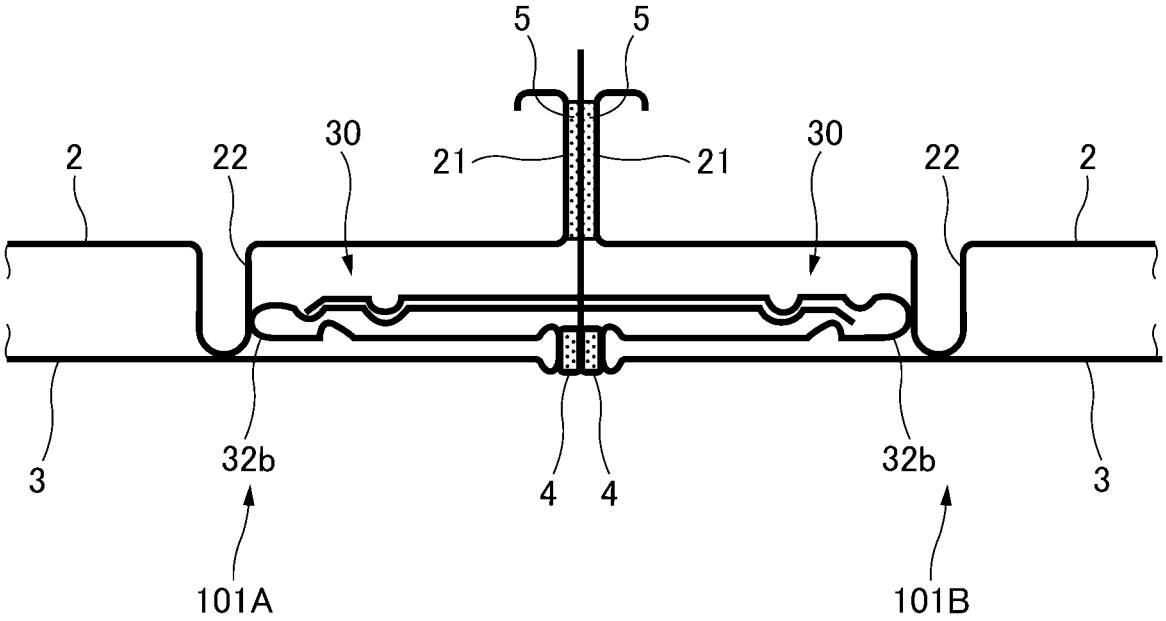
FIG. 10 is a sectional view of the external joint portion and the internal joint portion of the dew-condensation preventing square duct of FIG. 2, showing the facing joint portions of the pair of ducts being connected.

Next, in order to connect the dew-condensation preventing square duct 101A and the dew-condensation preventing square duct 101B, first as shown in FIG. 9, an end part of the dew-condensation preventing square duct 101A is placed so as to face the corresponding end part of the dew-condensation preventing square duct 101B. Then, as described above, the upper joint portion 33 of the internal joint portion 30 of the internal square duct 103A is fitted between the upper joint portion 33 and the middle joint portion 32 of the internal joint portion 30 of the internal square duct 103B. Or alternatively, the upper joint portion 33 of the internal joint portion 30 of the internal square duct 103B is fitted between the upper joint portion 33 and the middle joint portion 32 of the internal joint portion 30 of the internal square duct 103A. As a result, as shown in FIGS. 8 and 10, the internal square duct 103A is connected to the internal square duct 103B. In making the connection, with regard to one internal joint portion 30 of the internal square duct 103A, the upper joint portion 33 of the internal square duct 103A may be fitted into the internal square duct 103B, while with regard to another internal joint portion 30 of the internal square duct 103A, the upper joint portion 33 of the internal square duct 103B may be fitted into the internal square duct 103A. In other words, among the four internal joint portions 30 of the internal square duct 103A, all of the four internal joint portions 30 may be fitted into the internal square duct 103B. Or alternatively, some of the internal joint portions 30 may be fitted into the internal square duct 103B, or the internal square duct 103 may be fitted into all of the internal joint portions 30.

As describe above, the internal square duct 103A and the internal square duct 103B are connected to each other, and thereby, between each of the mutually-facing internal joint portions 30, the packing 4 of the internal square duct 103A comes into contact with the packing 4 of the internal square duct 103B, thereby making the contact airtight. Further, the hooking portion 33*a* of the internal square duct 103A hooks the middle hooked portion 32*a* of the internal square duct 103B and the hooking portion 33*a* of the internal square duct 103B hooks the upper hooked portion 33*b* of the internal square duct 103A. Or alternatively, the hooking portion 33*a* of the internal square duct 103B hooks the middle hooked portion 32*a* of the internal square duct 103A and the hooking portion 33*a* of the internal square duct 103A hooks the upper hooked portion 33*b* of the internal square duct 103B. Still further, the reinforcing rib 33*c* of the internal square duct 103A and the reinforcing rib 33*c* of the internal square duct 103B are superposed on top of each other.

On the other hand, in this state, the mutually-facing pieces of packing 5 of the external square ducts 102A and 102B are in contact with each other. Then, into each of the bolt holes 6*a* of the mutually-facing corner pieces 6 of the external square ducts 102A and 102B, a bolt is inserted and held with a nut, thereby connecting the external square duct 102A and the external square duct 102B. Hence, the dew-condensation preventing square duct 101A is connected to the dew-condensation preventing square duct 101B.

As described above, in the dew-condensation preventing square duct 101A, the heat insulating layer (air layer) S having the predetermined thickness T is provided between the external square duct 102A and the internal square duct 103A. Even if the dew-condensation preventing square duct 101A has a large difference in temperature between the inside and the outside, then because of the heat insulating layer S, dew condensation thereon can be prevented without winding a heat insulating material around the duct. This dispenses with the labor and time necessary for winding a heat insulating material and the disposal or the like of wastes of the heat insulating material. Further, the work-execution schedule, the carriage and keeping of materials for duct installation, and the like, can be easily coordinated. Still further, the number of workers can be reduced, thereby decreasing the cost and enhancing the safety.

In addition, the holding protrusion 22 enables the heat insulating layer S to keep the predetermined thickness T, thereby preventing dew condensation stably over a long period of time.

Furthermore, the holding protrusion 22 holds the internal square duct 103A in the axial directions. In other words, the internal square duct 103A is kept unmoved in the axial directions. Therefore, the external square duct 102A and the internal square duct 103A can stably form and hold the heat insulating layer S, thereby preventing dew condensation stably over a long period of time.

Moreover, the holding protrusion 22 as the thickness holding portion is shaped/formed by protruding a part of the external wall portion 2 toward the internal wall portion 3 and bending the part. The simple structure makes it possible to produce the holding protrusion 22 easily at a low cost and keep the heat insulating layer S at the predetermined thickness T stably over a long period of time.

In addition, the holding protrusion 22 as the axial-direction holding portion is shaped/formed by protruding the external wall portion 2 toward the internal wall portion 3 and bending the external wall portion such that the axial-direction holding portion comes into contact with the bent part 32*b* of the upper joint portion 33 and the middle joint portion 32 of the internal joint portion 30. The simple structure is created by bending the external wall portion 2 and simply utilizing the bent part 32*b* of the internal joint portion 30. Hence, the holding protrusion 22 can be produced easily at a low cost and can hold the internal square duct 103A stably over a long period of time.

Furthermore, an end part of each external wall portion 2 is formed with the external joint portion 21 extending outward substantially perpendicularly and an end part of each internal wall portion 3 is formed with the internal joint portion 30 extending substantially parallel to the plate surface of the internal wall portion 3. In other words, the external joint portion 21 is not parallel to the internal joint portion 30, and the former is substantially perpendicular to the latter. This arrangement prevents the external joint portion 21 and the internal joint portion 30 from interfering with each other, thereby facilitating conducting the joint work securely. Further, the internal joint portions 30 are first connected to each other, and the tentative connection enables the external joint portions 21 to be easily and flexibly connected to each other.

Specifically, the upper joint portion 33 of the internal joint portion 30 of the internal square duct 103A is fitted between the upper joint portion 33 and the middle joint portion 32 of the internal joint portion 30 of the internal square duct 103B, or the upper joint portion 33 of the internal joint portion 30 of the internal square duct 103B is fitted between the upper joint portion 33 and the middle joint portion 32 of the internal joint portion of the internal square duct 103A. This fitting is simply conducted to connect the internal square duct 103A to the internal square duct 103B. Therefore, the internal square duct 103A can be connected easily and within a short time to the internal square duct 103B. Further, even in a narrow space, a high position or the like, a worker can make the connection appropriately (without any connection fault caused by a leak in the connection part, or the like) without a heavy burden. Still further, the worker does not have to use any tool, thereby making the work safer and easier. Still further, the corner pieces 6 of the external square ducts 102A and 102B are utilized, the facing corner pieces 6 are each fastened with a bolt and a nut. This simple work enables a easy and swift connection of the external square ducts 102A and 102B to connect the dew-condensation preventing square duct 101A to the dew-condensation preventing square duct 101B.

Moreover, among the four internal joint portions of the internal square duct 103A, the upper joint portion 33 of one internal joint portion 30 may be fitted between the upper joint portion 33 and the middle joint portion 32 of the internal joint portion 30 of the internal square duct 103B, or the upper joint portion 33 of the internal joint portion 30 of the internal square duct 103B may be fitted between the upper joint portion 33 and the middle joint portion 32 of another internal joint portion 30. In other words, a worker can conduct the fitting, regardless of which of the upper joint portions 33 of the internal square duct 103A and the internal square duct 103B should be fitted. Hence, the worker does not have to pay attention to the upper joint portion 33 to be fitted, so that the worker can make the connection more easily and within a shorter time.

In addition, the internal square duct 103A is connected to the internal square duct 103B, and thereby, the hooking portion 33*a* of the internal square duct 103A hooks the middle hooked portion 32*a* of the internal square duct 103B and the hooking portion 33*a* of the internal square duct 103B hooks the upper hooked portion 33*b* of the internal square duct 103A, or the hooking portion 33*a* of the internal square duct 103B hooks the middle hooked portion 32*a* of the internal square duct 103A and the hooking portion 33*a* of the internal square duct 103A hooks the upper hooked portion 33*b* of the internal square duct 103B. This prevents and restrains the internal square duct 103A and the internal square duct 103B from disconnecting, and hence, the connection becomes appropriate and strong.

Furthermore, the internal joint portions 30 of the internal square duct 103A and the internal square duct 103B are individually formed with the reinforcing rib 33*c*. Therefore, the internal joint portions 30 strengthen, and thereby, the internal square duct 103A can be appropriately and strongly connected to the internal square duct 103B. Further, the internal square duct 103A and the internal square duct 103B connect each other, and thereby, the reinforcing rib 33*c* of the internal square duct 103A and the reinforcing rib 33*c* of the internal square duct 103B are superposed on each other. This makes the connection more appropriate and stronger.

Second Embodiment

FIGS. 11 to 15 show a second embodiment of the present invention. In this embodiment, the configuration differs from that of the first embodiment in the respect that the second embodiment is provided with a joining body 7. The component elements are given the same reference numerals and characters as those of the first embodiment, as long as the former are identical to the latter. Thus, their description is omitted.

Figure 12:
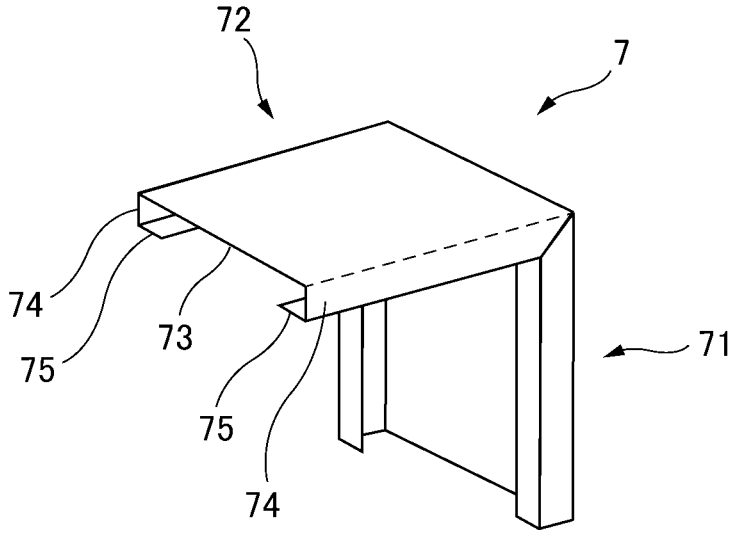
FIG. 12 is a perspective view of the joining body of FIG. 11, showing both end parts of the second joining portion being closed.

The joining body 7 is a metal fitting which after the internal square duct 103A is connected to the internal square duct 103B, joins a corner part C of the internal square duct 103A and the internal square duct 103B. Specifically, as shown in FIG. 12, the whole joining body 7 is a substantially L-shaped body, and includes a first joining portion 71 having a substantially C-shape in section and extending straight and a second joining portion 72 having a substantially C-shape in section and extending substantially perpendicularly to the first joining portion 71 from an end of the first joining portion 71. The C-shape openings of the first joining portion 71 and the second joining portion 72 are directed to the inside of the L-shape. Specifically, the joining body 7 is formed by bending a member having a C-shape in section, the member including: a rectangular main plane portion 73; a perpendicular portion (end part) 74 which protrudes perpendicularly to the main plane portion 73 individually from both side edges of the main plane portion 73; and a horizontal portion (end part) 75 which protrudes parallel to the main plane portion 73 individually from both edges of the perpendicular portion 74. The joining body 7 is formed by bending the member along the middle part such that the perpendicular portion 74 and the horizontal portion 75 are directed to the inside of the L-shape. The bent part corresponds to the boundary between the first joining portion 71 and the second joining portion 72.

Figure 11:
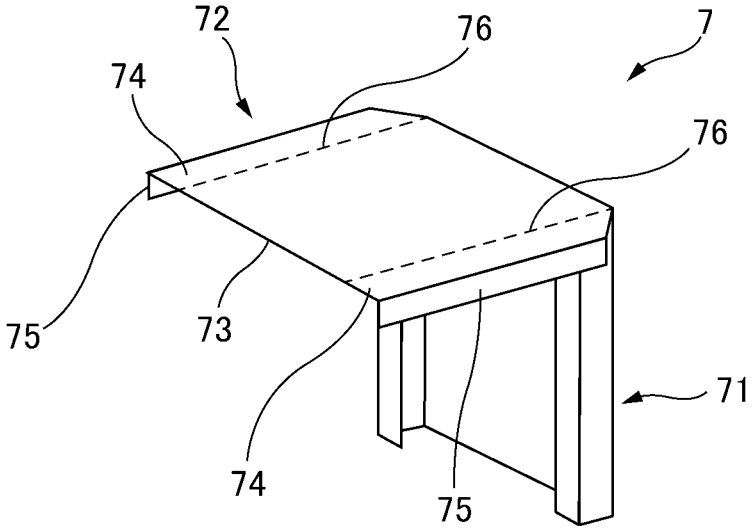
FIG. 11 is a perspective view of a joining body of an internal square duct according to a second embodiment of the present invention, showing both end parts of a second joining portion being opened.

Both end parts of the C-shape of the second joining portion 72 can be freely opened and closed. Specifically, as shown in FIG. 11, a perforation 76 is formed on the boundary between the main plane portion 73 and the perpendicular portion 74 of the second joining portion 72. Specifically, before the joining body 7 is used (when produced), both perpendicular portions 74 are opened and substantially in the same plane as the main plane portion 73. Then, both perpendicular portions 74 are bent along the perforations 76, and thereby, as shown in FIG. 12, both perpendicular portions 74 are closed.

Figure 14:
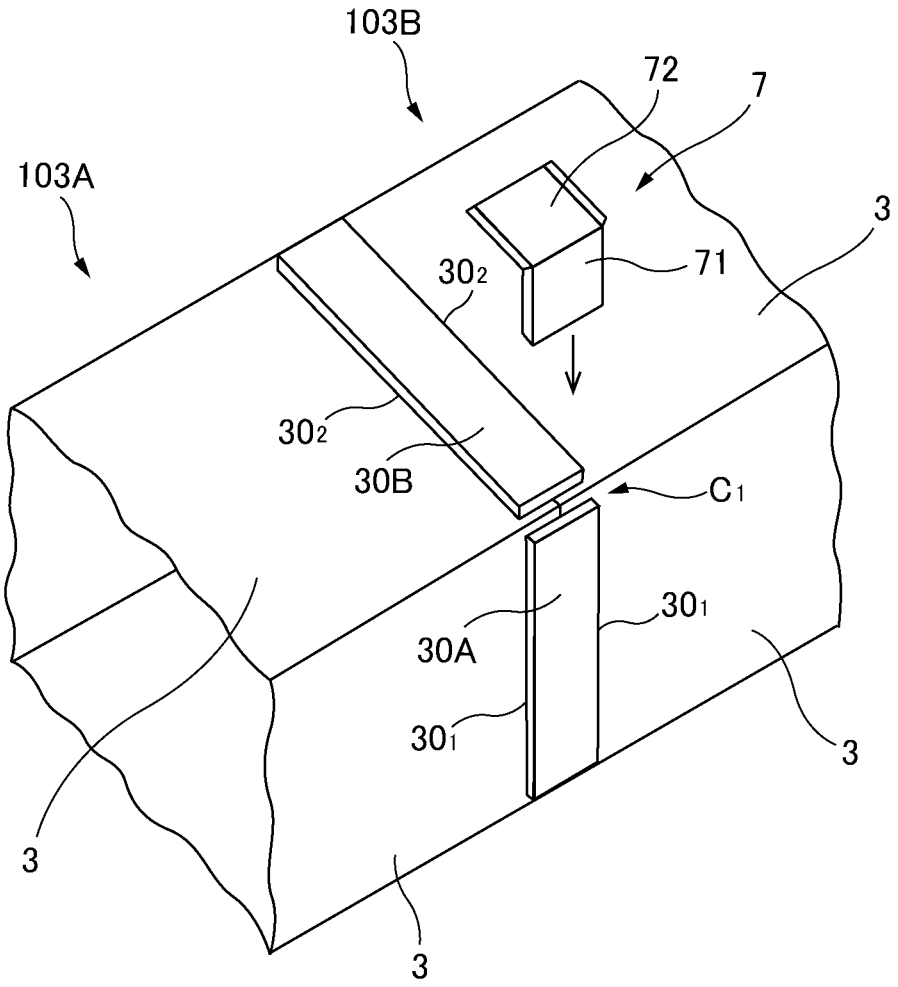
FIG. 14 is a perspective view of the internal square ducts and the joining body of FIG. 11 before being attached thereto.

The joining body 7 is attached in the following manner. As shown in FIG. 14, a first superposition portion 30A is formed by superposing on top of each other a first internal joint portion $\mathbf{30}_1$ equivalent to one of the internal joint portions 30 of the internal square duct 103A and the first internal joint portion $\mathbf{30}_1$ equivalent to the internal joint portion 30 of the internal square duct 103B which has a fitting relation to the first internal joint portion $\mathbf{30}_1$. On the other hand, a second superposition portion 30B is formed by superposing on top of each other a second internal joint portion $\mathbf{30}_2$ equivalent to the internal joint portion 30 adjacent to the first internal joint portion $\mathbf{30}_1$ of the internal square duct 103A and a second internal joint portion $\mathbf{30}_2$ equivalent to the internal joint portion 30 of the internal square duct 103B which has a fitting relation to the second internal joint portion $\mathbf{30}_2$. An example will be below described in which the joining body 7 is attached to a corner part $C_1$ formed by the first superposition portion 30A and the second superposition portion 30B.

First, as shown in FIG. 11, both perpendicular portions 74 of the second joining portion 72 are opened, and as shown in FIG. 14, from an edge of the first superposition portion 30A, the end part of the first superposition portion 30A is fitted into the C-shape of the first joining portion 71. At this time, the edge of the first superposition portion 30A is inserted between both perpendicular portions 74 of the first joining portion 71. Then, the first joining portion 71 is slid along the first superposition portion 30A, and thereby, the end part of the first superposition portion 30A is housed in the space (in the C-shape) formed by both perpendicular portions 74 and both horizontal portions 75.

Figure 15:
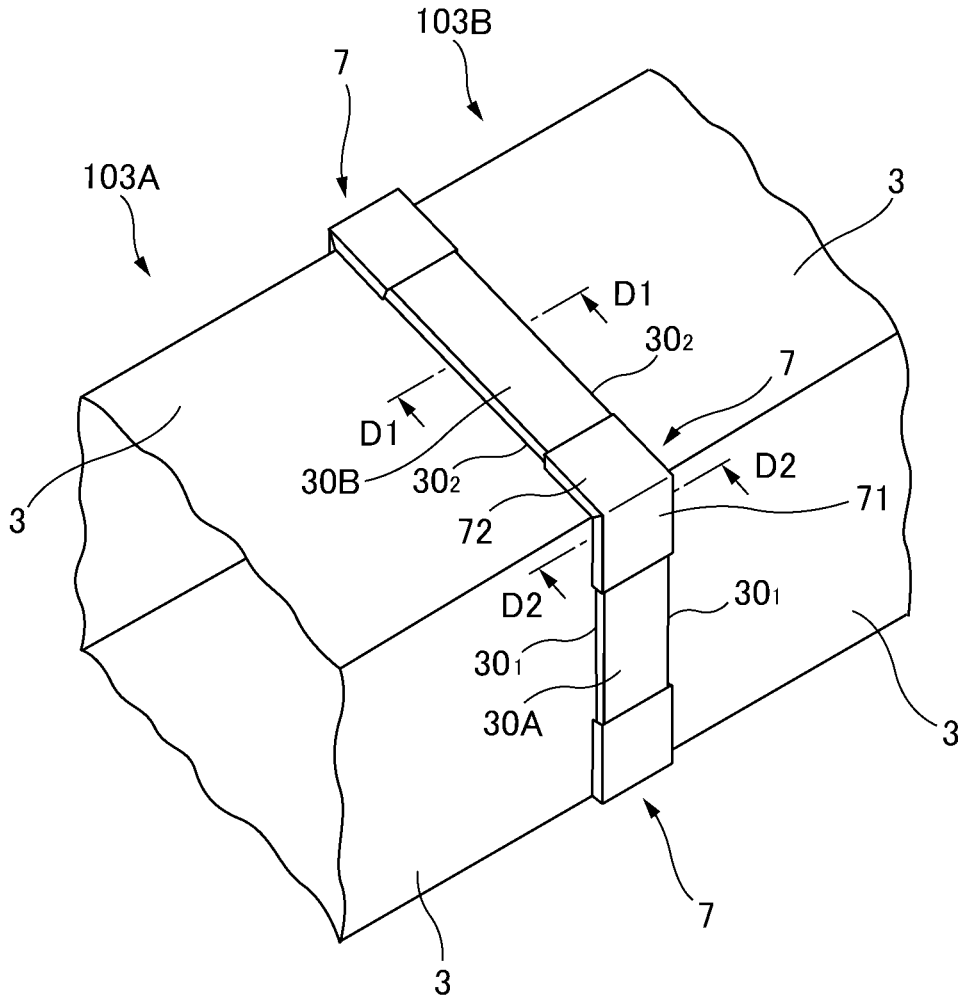
FIG. 15 is a perspective view of the internal square ducts and the joining body of FIG. 11 after being attached thereto.

Next, the first joining portion 71 is slid up to the position where the main plane portion 73 of the second joining portion 72 comes into contact with the second superposition portion 30B. As a result, the second joining portion 72 is located in the end part of the second superposition portion 30B. Then, both perpendicular portions 74 corresponding to both end parts in the C-shape of the second joining portion 72 are closed, and as shown in FIG. 15, the end part of the second superposition portion 30B is fitted into the C-shape of the second joining portion 72 and housed there. Hence, the joining body 7 is joined to the corner part $C_1$.

Figure 13:
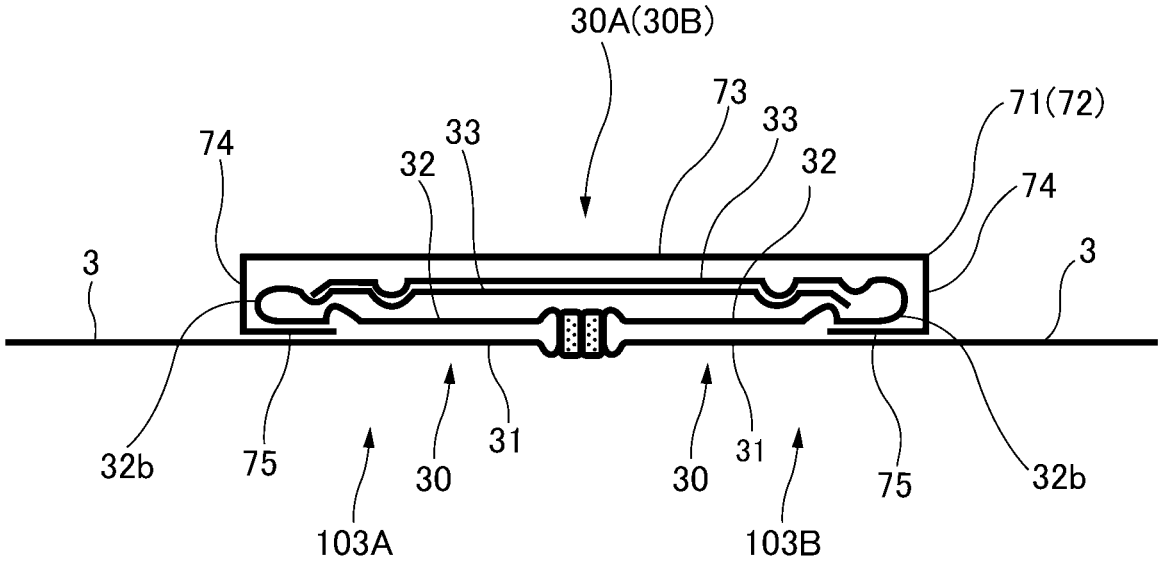
FIG. 13 is a sectional view (along the D2-D2 line of FIG. 15) of the internal square ducts and the joining body of FIG. 11 attached thereto.

When the joining body 7 is attached in this manner, as shown in FIG. 13, the first joining portion 71 and the second joining portion 72 are fitted to the first superposition portion 30A and the second superposition portion 30B respectively. With regard to the first joining portion 71, the main plane portion 73 of the first joining portion 71 faces the upper joint portion 33 of the internal joint portion 30, and both perpendicular portions 74 individually faces the bent part 32*b* of the internal joint portion 30. Both horizontal portions 75 are individually located between the lower joint portion 31 and the middle joint portion 32 of the internal joint portion 30.

In this embodiment, the holding protrusion 22 of each external wall portion 2 of the external square duct 102A is positioned so as to come into contact with the perpendicular portion 74 of the joining body 7. Since the holding protrusion 22 is in contact with the joining body 7, the internal square duct 103A is kept unmoved in the axial directions.

As described above, in this embodiment, the internal square duct 103A is connected to the internal square duct 103B, and the joining body 7 joins the corner part C of the internal square duct 103A and the internal square duct 103B. Therefore, the connection and shape of the internal square duct 103A and the internal square duct 103B can be strongly maintained.

In conducting this process, for example, the end part of the first superposition portion 30 of the internal square duct 103A and the internal square duct 103B is fitted into the C-shape of the first joining portion 71 of the joining body 7, and then, the joining body 7 is slid. Next, both perpendicular portions 74 of the second joining portion 72 are closed, and the end part of the second superposition portion 30 is fitted into it. The simple process is only conducted, and thereby, the corner parts C can be easily and appropriately joined together. Further, a worker does not have to use any tool, thereby making the work safer and easier.

Third Embodiment

Figure 16:
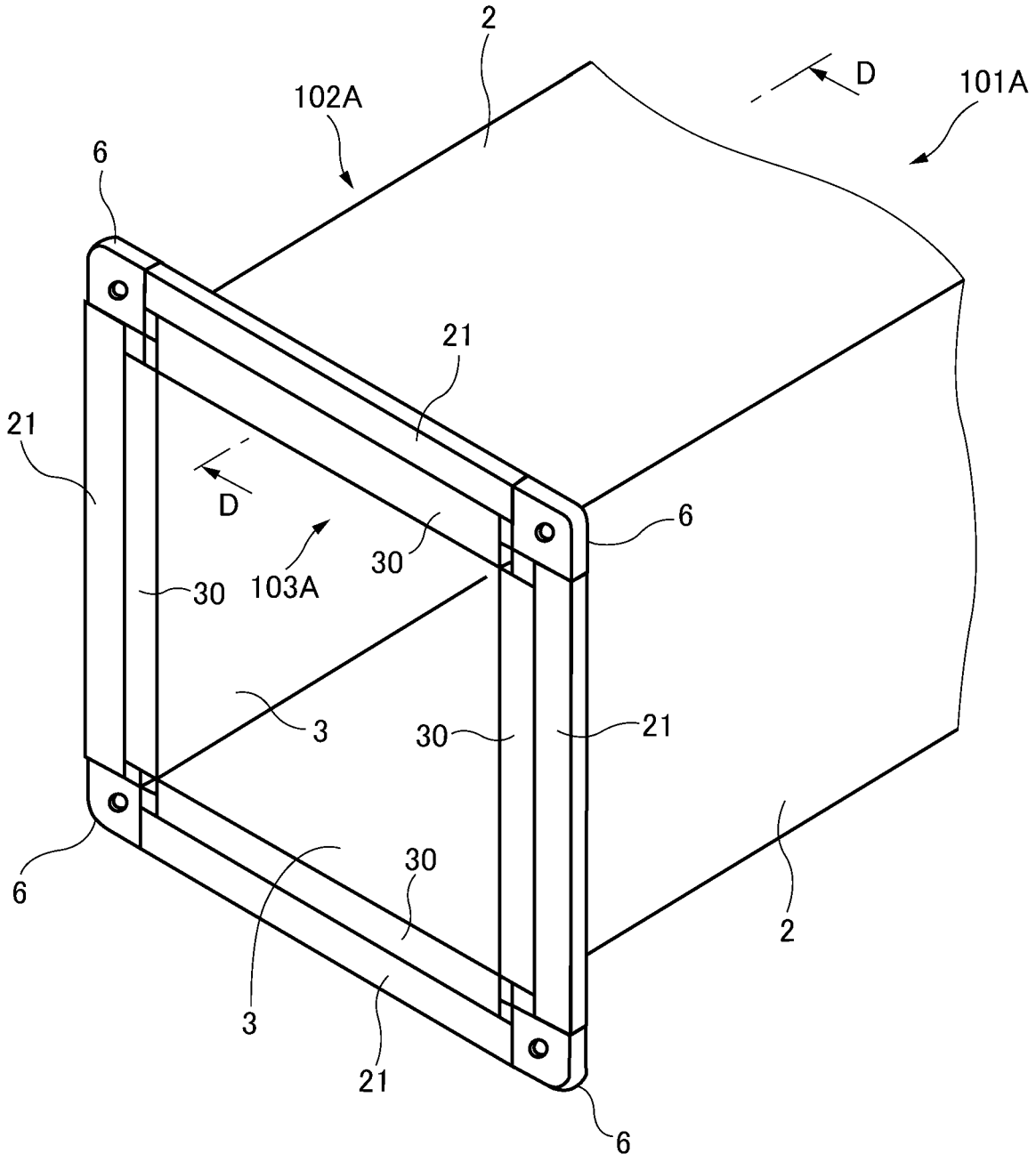
FIG. 16 is a perspective view of the dew-condensation preventing square duct according to a third embodiment of the present invention.
Figure 17:
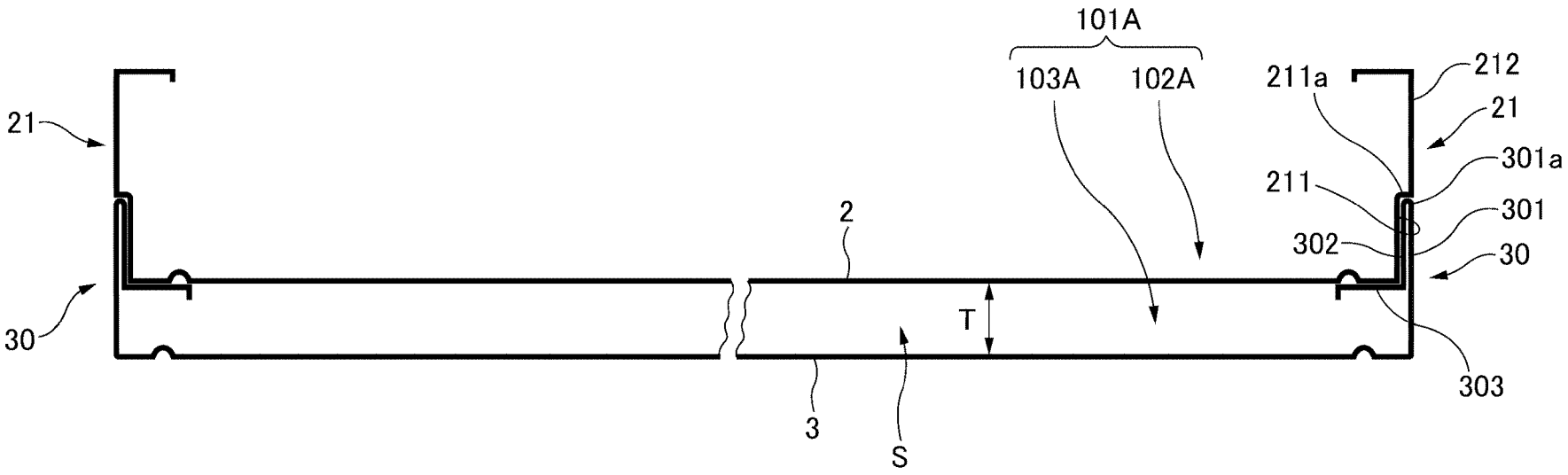
FIG. 17 is a sectional view (along the D-D line of FIG. 16) showing an arrangement relation between an external wall portion and an internal wall portion of the dew-condensation preventing square duct of FIG. 16.

FIGS. 16 to 20 show a third embodiment of the present invention. In this embodiment, as shown in FIGS. 16 and 17, both end parts of each external wall portion 2 are individually formed with the external joint portion 21 extending outward substantially perpendicularly to the plate surface of the external wall portion 2, and both end parts of each internal wall portion 3 are individually formed with the internal joint portion 30 extending outward substantially perpendicularly to the plate surface of the internal wall portion 3 and being substantially in the same plane as the external joint portion 21. In this respect, the configuration differs from that of the first embodiment. The component elements are given the same reference numerals and characters as those of the first embodiment, as long as the former are identical to the latter. Thus, their description is omitted.

Figure 18:
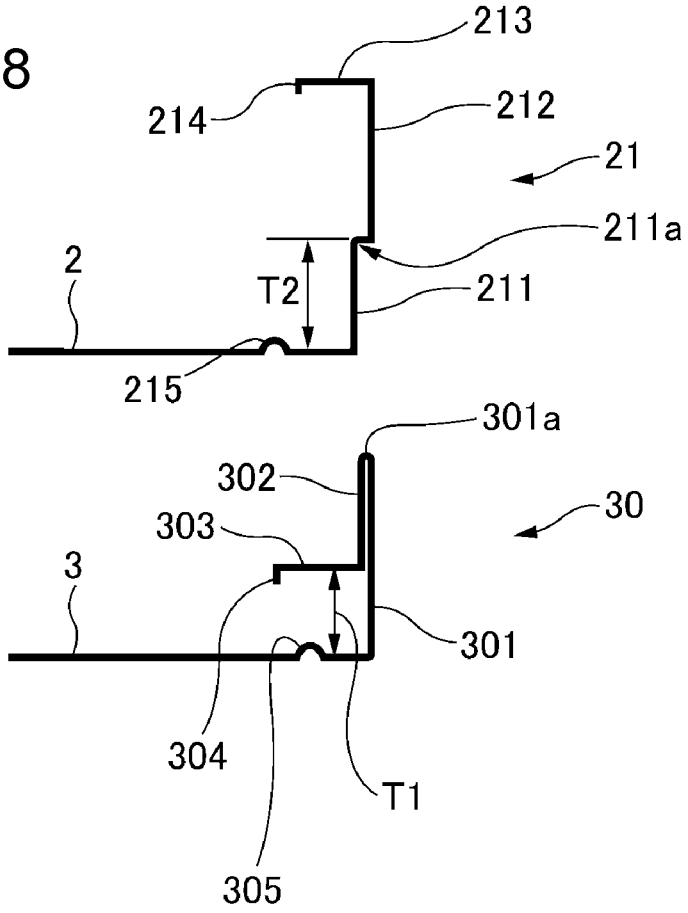
FIG. 18 is a sectional view of an external joint portion of an internal joint portion of the dew-condensation preventing square duct of FIG. 16.

As shown in FIG. 18, the external joint portion 21 includes: a first external-wall perpendicular portion 211 formed by bending the end part of the external wall portion 2 outward (perpendicularly to the axial directions and toward the opposite side to the internal wall portion 3) substantially perpendicularly to the plate surface of the external wall portion 2; and a second external-wall perpendicular portion 212 protruding outward (toward the opposite side to the external wall portion 2 in the axial directions) from the first external-wall perpendicular portion 211 on the free-end side of the first external-wall perpendicular portion 211. In other words, both the first external-wall perpendicular portion 211 and the second external-wall perpendicular portion 212 extend substantially perpendicularly to the plate surface of the external wall portion 2. A stepped part 211*a* is formed between the first external-wall perpendicular portion 211 and the second external-wall perpendicular portion 212.

The stepped part 211*a* is designed, as described later, to have a width (the protrusion length of the second external-wall perpendicular portion 212 from the first external-wall perpendicular portion 211) by which a first internal-wall perpendicular portion 301 is substantially in the same plane as the second external-wall perpendicular portion 212 when the first internal-wall perpendicular portion 301 and a second internal-wall perpendicular portion 302 are housed in the stepped part 211*a*. On the other hand, the stepped part 211*a* or the first external-wall perpendicular portion 211 is designed to have a height T2 by which a wide gap will not be formed between a bent part 301*a* of the first internal-wall perpendicular portion 301 and the second internal-wall perpendicular portion 302 and the corner part of the stepped part 211*a* when the internal-wall perpendicular portions 301 and 302 are housed in the stepped part 211*a*. Specifically, the height T2 or the height of the second internal-wall perpendicular portion 302 described later is slightly smaller than the height of the second external-wall perpendicular portion 212. Hence, the bent part 301*a* is located in the middle part of the external joint portion 21.

The second external-wall perpendicular portion 212 is provided on the free-end side with: a piece housing portion 213 formed by bending it substantially parallel to the plate surface of the external wall portion 2; and a first piece stopper portion 214 formed by bending the free end of the piece housing portion 213 inward substantially perpendicularly to the plate surface of the external wall portion 2. The external wall portion 2 is formed on the side of the external joint portion 21 with a second piece stopper portion 215 protruding outward in a convex shape. The corner piece 6 is held in the plate-thickness directions between the external joint portion 21 (the first external-wall perpendicular portion 211) and the second piece stopper portion 215. Then, the first piece stopper portion 214 is bent toward the corner piece 6, and thereby, the corner piece 6 is housed in the piece housing portion 213 and attached thereto.

The internal joint portion 30 includes: a first internal-wall perpendicular portion 301 formed by bending the end part of the internal wall portion 3 outward (perpendicularly to the axial directions and toward the side of the external wall portion 2) substantially perpendicularly to the plate surface thereof; a second internal-wall perpendicular portion 302 formed by bending the end part of the internal wall portion 3 toward the internal wall portion 3 such that the second internal-wall perpendicular portion 302 is superposed on the first internal-wall perpendicular portion 301; and an internal-wall horizontal portion 303 formed by bending the end part of the internal wall portion 3 on the free-end side of the second internal-wall perpendicular portion 302 substantially parallel to the plate surface of the internal wall portion 3. In other words, the internal-wall perpendicular portions 301 and 302 are superposed on each other and extend substantially perpendicularly to the internal wall portion 3. Then, from the second internal-wall perpendicular portion 302, the internal-wall horizontal portion 303 extends substantially parallel to the internal wall portion 3. Reference character and numeral T1 denotes a height of the internal-wall horizontal portion 303 from the plate surface of the internal wall portion 3. The height T1 is determined such that when the internal-wall horizontal portion 303 comes into contact with the inner surface of the external wall portion 2, the heat insulating layer S having the predetermined thickness T is formed between the external wall portion 2 and the internal wall portion 3.

As shown in FIG. 17, the second internal-wall perpendicular portion 302 faces the first external-wall perpendicular portion 211, and the first internal-wall perpendicular portion 301 is substantially in the same plane as the second external-wall perpendicular portion 212. Then, the internal-wall horizontal portion 303 comes into contact with the external wall portion 2 and functions as the thickness holding portion. In short, the superposition part of the internal-wall perpendicular portions 301 and 302 is housed in the stepped part 211*a* of the external joint portion 21, and thereby, the first internal-wall perpendicular portion 301 is substantially in the same plane as the second external-wall perpendicular portion 212; and the internal-wall horizontal portion 303 comes into contact with the external wall portion 2, and thereby, the heat insulating layer S having the predetermined thickness T is formed between the external wall portion 2 and the internal wall portion 3.

In addition, the second internal-wall perpendicular portion 302 comes into contact with the first external-wall perpendicular portion 211, and thereby, the internal-wall perpendicular portions 301 and 302 function as the axial-direction holding portion to keep the internal square duct 103A unmoved in the axial directions.

The free end part of the internal-wall horizontal portion 303 is formed, as shown in FIG. 18, with a perpendicular reinforcing portion 304, and the perpendicular reinforcing portion 304 is bent inward substantially perpendicularly to the plate surface of the internal wall portion 3 and is capable of reinforcing the internal-wall horizontal portion 303. Similarly, the part of the internal wall portion 3 facing the internal-wall horizontal portion 303 is formed with a convex reinforcing portion 305, and the convex reinforcing portion 305 protrudes toward the internal-wall horizontal portion 303 and is utilized for reinforcing the internal wall portion 3 and the internal joint portion 30.

Figure 19:
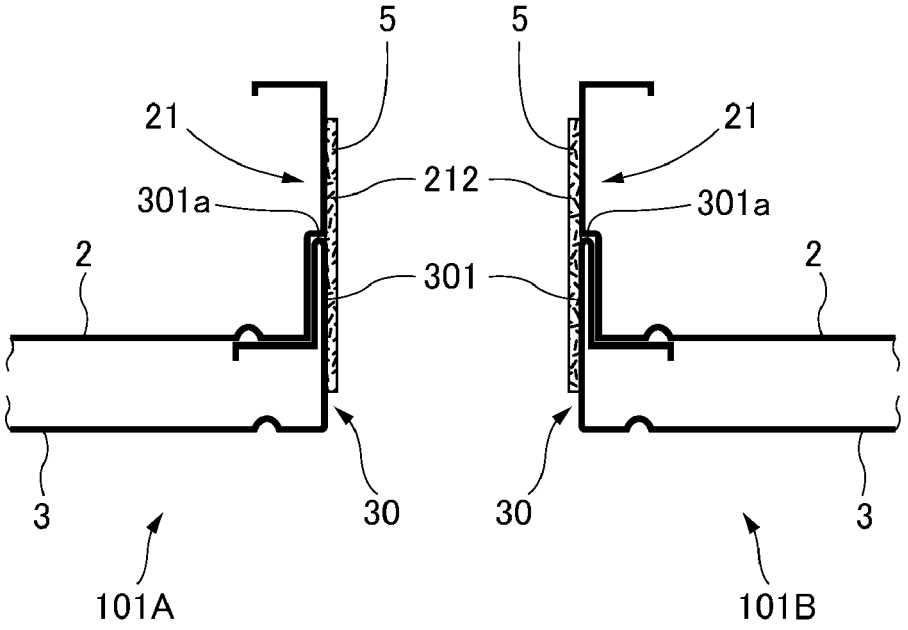
FIG. 19 is a sectional view of the external joint portion and the internal joint portion of the dew-condensation preventing square duct of FIG. 16, showing the facing joint portions of a pair of the ducts being unconnected.

As shown in FIG. 19, the belt-shaped packing 5 is attached to the second external-wall perpendicular portion 212 and the first internal-wall perpendicular portion 301 across the bent part 301*a* as the middle part thereof. The packing 5 is utilized for making this part airtight.

Figure 20:
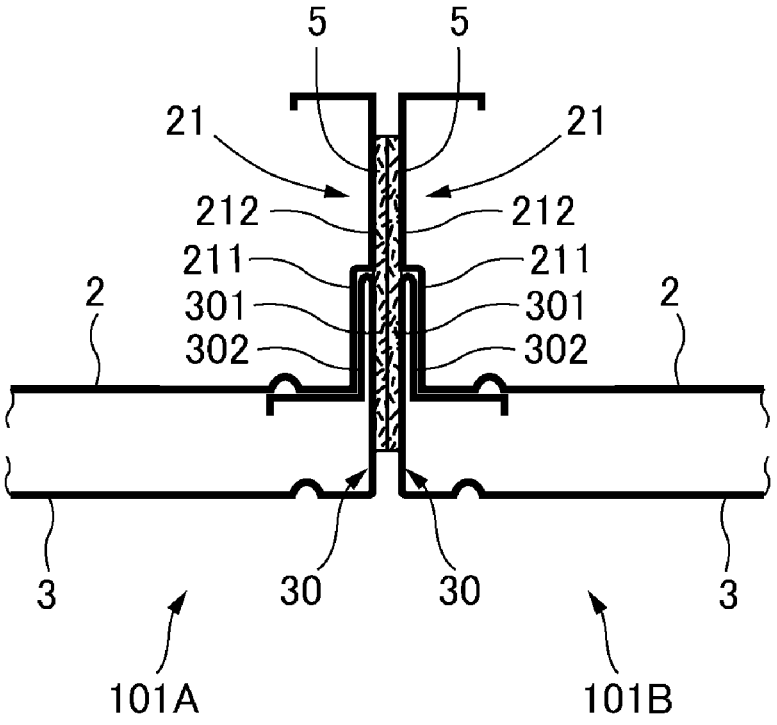
FIG. 20 is a sectional view of the external joint portion and the internal joint portion of the dew-condensation preventing square duct of FIG. 16, showing the facing joint portions of the pair of ducts being connected.

The thus-configured dew-condensation preventing square duct 101A and dew-condensation preventing square duct 101B are connected to each other in the following manner. As shown in FIG. 20, both pieces of packing 5 of the dew-condensation preventing square ducts 101A and 101B are placed together, or in other words, both external joint portions 21 and both internal joint portions 30 are respectively placed together. Then, into each of the bolt holes 6*a* of the mutually-facing corner pieces 6 of the external square ducts 102A and 102B, a bolt is inserted and held with a nut, thereby connecting both of the corresponding external joint portions 21 of the dew-condensation preventing square ducts 101A and 101B. Besides, the internal-wall perpendicular portions 301 and 302 are sandwiched between the first external-wall perpendicular portions 211 of the external joint portions 21, thereby connecting both internal joint portions 30.

As described above, according to this embodiment, the end parts of each external wall portion 2 are individually formed with the external joint portion 21 extending outward substantially perpendicularly, and the end parts of each internal wall portion 3 are individually formed with the internal joint portion 30 extending outward substantially perpendicularly and being substantially in the same plane as the external joint portion 21. Therefore, the external joint portion 21 and the internal joint portion 30 are individually subjected to the corresponding joint process (connection work) simultaneously in the same plane. In other words, if the external joint portion 21 is subjected to the joint process (fastening the corner pieces 6 with a bolt), then at the same time, the internal joint portion 30 will also be subjected to the joint process. This makes it possible to reduce the time and lighten the labor. Further, the internal joint portion 30 does not protrude from the external joint portion 21, so that a worker can carry and handle the duct more easily and safely.

In addition, the end part of the internal wall portion 3 is bent outward substantially perpendicularly and then is bent substantially parallel, to shape/form the internal-wall perpendicular portion (the axial-direction holding portion) 301, 302 and the internal-wall horizontal portion (thickness holding portion) 303. The simple structure makes it possible to produce them easily at a low cost and keep the heat insulating layer S at a predetermined thickness stably over a long period of time.

In more detail, the second internal-wall perpendicular portion 302 faces the first external-wall perpendicular portion 211, the first internal-wall perpendicular portion 301 is substantially in the same plane as the second external-wall perpendicular portion 212. Specifically, the first external-wall perpendicular portion 211 and the second external-wall perpendicular portion 212 forms the stepped part 211*a*, and the stepped part 211*a* houses the first internal-wall perpendicular portion 301 and the second internal-wall perpendicular portion 302. Hence, the first internal-wall perpendicular portion 301 is substantially in the same plane as the second external-wall perpendicular portion 212 to unite the external joint portion 21 and the internal joint portion 30. As a result, if the external joint portion 21 is subjected to the joint process, then at the same time, the internal joint portion 30 will also be strongly subjected to the joint process.

In addition, in order to prevent a leak (air leak), sealing can be conducted for the bent part 301*a* of the first internal-wall perpendicular portion 301 and the second internal-wall perpendicular portion 302 which corresponds to the boundary between the external joint portion 21 and the internal joint portion 30. The bent part 301*a* is substantially in the same plane as the second external-wall perpendicular portion 212 and is also located in the middle part of the external joint portion 21. Hence, the bent part 301*a* can be easily and appropriately sealed (by attaching the packing 5) together with the second external-wall perpendicular portion 212. In other words, if a worker attaches the packing 5 to substantially the middle part of the external joint portion 21 without paying any attention to the position, then the packing 5 will securely cover the bent part 301*a* which may cause a leak. Hence, the sealing can be conducted easily and appropriately. In contrast, if a leak is caused in the end part (the bent part 301*a* or the like) of the external joint portion 21, then the worker has to conduct sealing for covering the end part, thereby requiring labor and time. In some cases, the sealing may not be appropriately conducted.

Furthermore, the second internal-wall perpendicular portion 302 comes into contact with the first external-wall perpendicular portion 211 to function as the axial-direction holding portion. The simple formation makes it possible to produce the axial-direction holding portion easily at a low cost and hold the internal square duct 103A stably over a long period of time.

Fourth Embodiment

Figure 21:
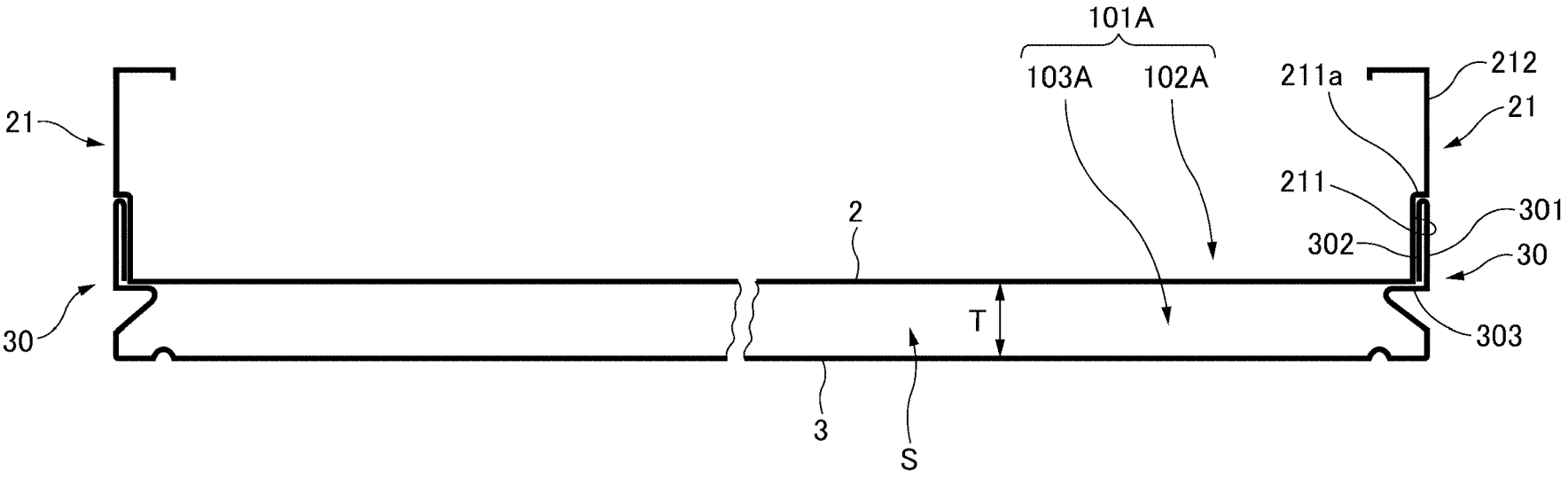
FIG. 21 is a sectional view (corresponding to the sectional view along the D-D line of FIG. 16) showing an arrangement relation between an external wall portion and an internal wall portion of a dew-condensation preventing square duct according to a fourth embodiment of the present invention.
Figure 22:
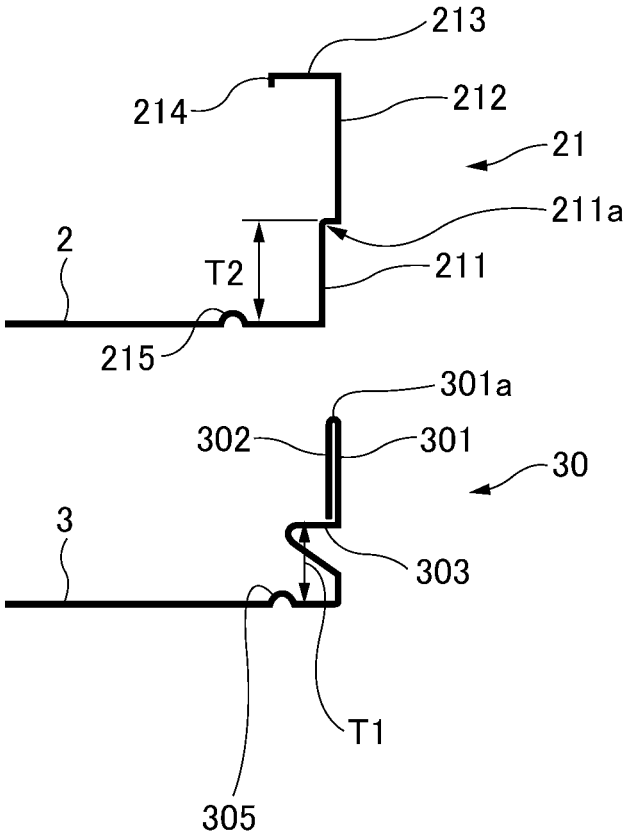
FIG. 22 is a sectional view of an external joint portion an internal joint portion of the dew-condensation preventing square duct according to the fourth embodiment.

FIGS. 21 to 24 show a fourth embodiment of the present invention. In this embodiment, as shown in FIGS. 21 and 22, the first internal-wall perpendicular portion 301 and the second internal-wall perpendicular portion 302 are formed in the free-end part of the internal joint portion 30 farther frontward than the internal-wall horizontal portion 303. In this respect, the configuration differs from that of the third embodiment. The component elements are given the same reference numerals and characters as those of the third embodiment, as long as the former are identical to the latter. Thus, their description is omitted.

The internal joint portion 30 includes: an internal-wall horizontal portion 303 formed by bending the end part of the internal wall portion 3 such that the end part protrudes toward the plate surface (toward the inside) of the internal wall portion 3; a first internal-wall perpendicular portion 301 formed by bending the free end part of the internal joint portion 30 outward from the internal-wall horizontal portion 303 and substantially perpendicularly to the plate surface of the internal wall portion 3; and a second internal-wall perpendicular portion 302 formed by bending the free end part of the internal joint portion 30 such that the free end part is superposed on the first internal-wall perpendicular portion 301. In other words, the internal joint portion 30 extending substantially perpendicularly to the plate surface of the internal wall portion 3 includes the internal-wall horizontal portion 303 located on the side of the plate surface (on the root side) of the internal wall portion 3. On the free-end side, the internal-wall perpendicular portions 301 and 302 are superposed on each other, and the first internal-wall perpendicular portion 301 is located on the outside (on the side of the internal joint portion 30 to be connected thereto).

The internal-wall horizontal portion 303 extends obliquely from the side of the plate surface of the internal wall portion 3, and continuously, extends substantially perpendicularly to the plate surface of the internal wall portion 3. Reference character and numeral T1 denotes a height of the internal-wall horizontal portion 303 from the plate surface of the internal wall portion 3. The height T1 is determined such that when the internal-wall horizontal portion 303 comes into contact with the inner surface of the external wall portion 2, the heat insulating layer S having the predetermined thickness T is formed between the external wall portion 2 and the internal wall portion 3.

As shown in FIG. 21, the second internal-wall perpendicular portion 302 faces the first external-wall perpendicular portion 211, and the first internal-wall perpendicular portion 301 is substantially in the same plane as the second external-wall perpendicular portion 212. Then, the internal-wall horizontal portion 303 comes into contact with the external wall portion 2 and functions as the thickness holding portion. In short, the superposition part of the internal-wall perpendicular portions 301 and 302 is housed in the stepped part 211*a* of the external joint portion 21, and thereby, the first internal-wall perpendicular portion 301 is substantially in the same plane as the second external-wall perpendicular portion 212; and the internal-wall horizontal portion 303 comes into contact with the external wall portion 2, and thereby, the heat insulating layer S having the predetermined thickness T is formed between the external wall portion 2 and the internal wall portion 3.

In addition, the second internal-wall perpendicular portion 302 comes into contact with the first external-wall perpendicular portion 211, and thereby, the internal-wall perpendicular portions 301 and 302 function as the axial-direction holding portion to keep the internal square duct 103A unmoved in the axial directions.

Figure 23:
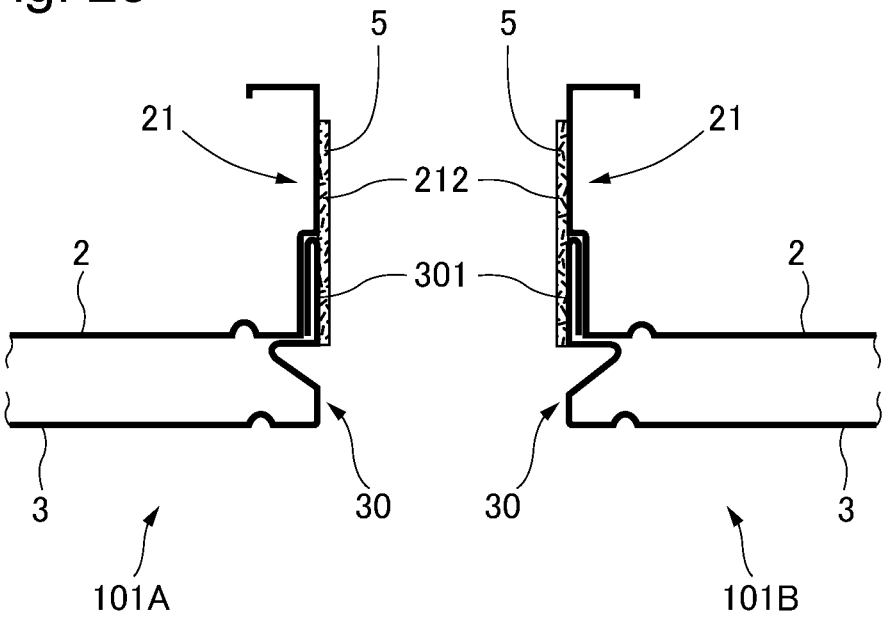
FIG. 23 is a sectional view of the external joint portion and the internal joint portion of the dew-condensation preventing square duct according to the fourth embodiment, showing the facing joint portions of a pair of the ducts being unconnected.

As shown in FIG. 23, the belt-shaped packing 5 is attached to the second external-wall perpendicular portion 212 and the first internal-wall perpendicular portion 301 such that the belt-shaped packing 5 crosses them. The packing 5 is utilized for making this part airtight.

Figure 24:
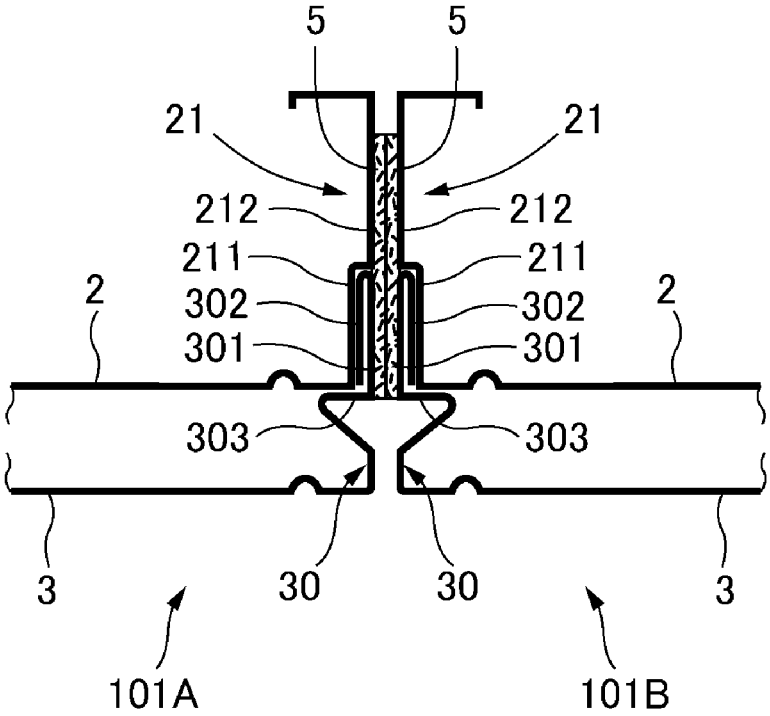
FIG. 24 is a sectional view of the external joint portion and the internal joint portion of the dew-condensation preventing square duct according to the fourth embodiment, showing the facing joint portions of the pair of ducts being connected.

The thus-configured dew-condensation preventing square duct 101A and dew-condensation preventing square duct 101B are connected to each other in the following manner. As shown in FIG. 24, both pieces of packing 5 of the dew-condensation preventing square ducts 101A and 101B are placed together, or in other words, both external joint portions 21 and both internal joint portions 30 are respectively placed together. Then, into each of the bolt holes 6*a* of the mutually-facing corner pieces 6 of the external square ducts 102A and 102B, a bolt is inserted and held with a nut, thereby connecting both of the corresponding external joint portions 21 of the dew-condensation preventing square ducts 101A and 101B. Besides, the internal-wall perpendicular portions 301 and 302 are sandwiched between the first external-wall perpendicular portions 211 of the external joint portions 21, thereby connecting both internal joint portions 30.

As described above, this embodiment has the same advantages as those of the third embodiment. Further, the first internal-wall perpendicular portion 301 and the second internal-wall perpendicular portion 302 are formed in the free-end part thereof farther frontward than the internal-wall horizontal portion 303. Hence, the internal joint portion 30 can be easily and appropriately formed.

Although the embodiments of the present invention have been above described, the present invention is not limited to the embodiments as specific configurations thereof. Without departing from the scope of the present invention, variations or the like in design should be included in the present invention. For example, in the above embodiments, as the connected body, the dew-condensation preventing square duct 101B has been employed which has the same structure as the dew-condensation preventing square duct 101A. However, the connected body may be a different type of air-conditioning equipment such as a chamber and a pipe joint.

In the first and second embodiments, the external wall portion 2 is formed with the thickness holding portion (holding protrusion 22), but the internal wall portion 3 may be formed with the thickness holding portion. In the case, the thickness holding portion can be formed by bending a part of the internal wall portion 3 such that the part protrudes toward the external wall portion 2. This enables the thickness holding portion to come into contact with the external wall portion 2. Further, the thickness holding portion or the axial-direction holding portion may be formed as a separate body from the external wall portion 2 or the internal wall portion 3.

Figure 25:
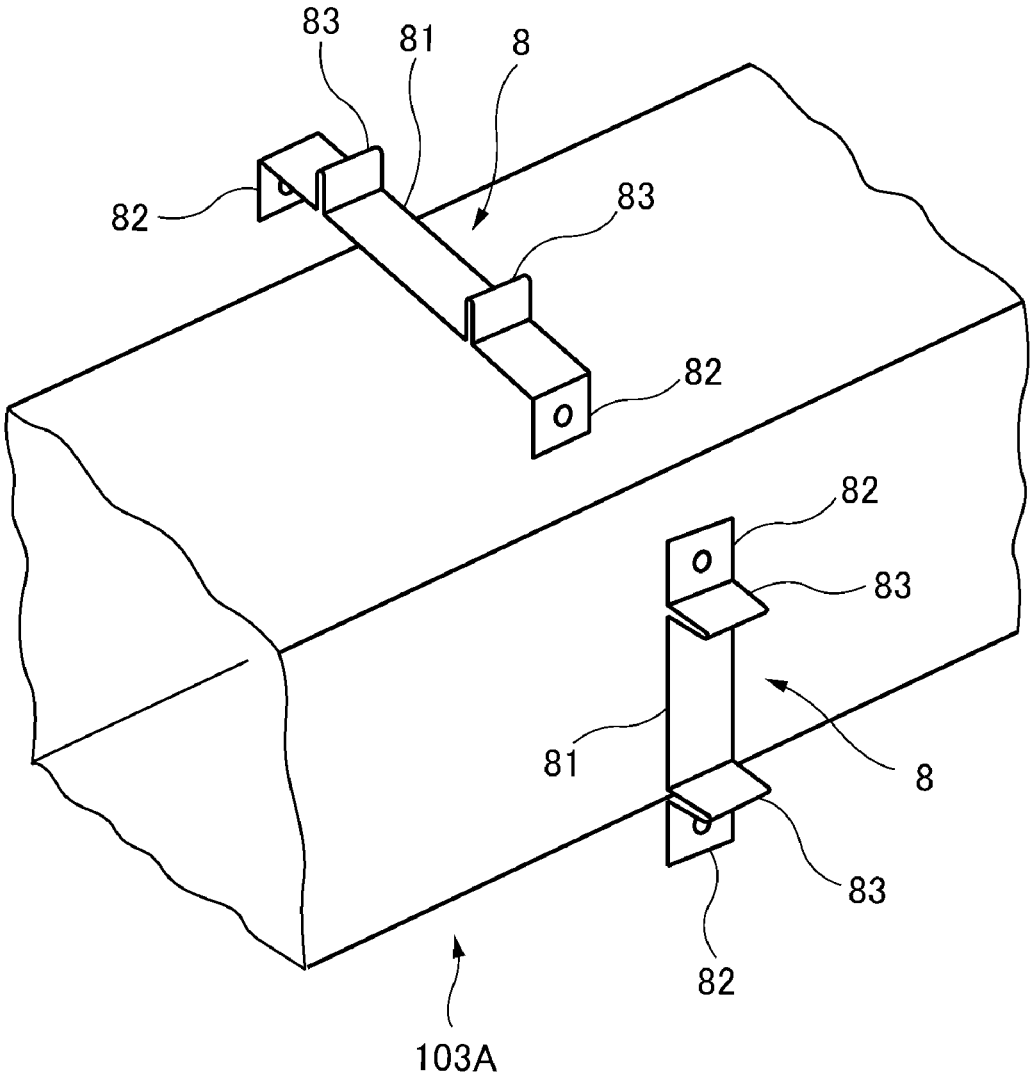
FIG. 25 is a perspective view of a dew-condensation preventing square duct according to another variation of the present invention.

For example, as shown in FIG. 25, a band-shaped thickness holding member (the thickness holding portion) 8 may be attached to the periphery of the internal square duct 103A. The thickness holding member 8 includes a belt-shaped body 81, connection portions 82 individually formed in each end part of the belt-shaped body 81, and clog support portions 83 located between the connection portions 82 and extending substantially perpendicularly to the belt-shaped body 81. The four thickness holding members 8 are individually connected by means of the corresponding connection portions 82 such that they are wound around the internal square duct 103A. The clog support portions 83 is utilized for forming the heat insulating layer S having the predetermined thickness T between the external square duct 102A and the internal square duct 103A.

In addition, in the third embodiment, the shapes of the external joint portion 21 and the internal joint portion 30 are not limited to the above. For example, without the second internal-wall perpendicular portion 302, the first internal-wall perpendicular portion 301 may be substantially in the same plane as the external joint portion 21, and the internal-wall horizontal portion 303 may come into contact with the external wall portion 2 to function as the thickness holding portion.

Description of the Symbols

101A dew-condensation preventing square duct
101B dew-condensation preventing square duct (connected body)
102A external square duct
103A internal square duct
2 external wall portion
21 external joint portion
22 holding protrusion
(thickness holding portion, axial-direction holding portion)
211 first external-wall perpendicular portion
211*a* stepped part
212 second external-wall perpendicular portion
3 internal wall portion
30 internal joint portion
$\mathbf{30}_1$ first internal joint portion
$\mathbf{30}_2$ second internal joint portion
30A first superposition portion
30B second superposition portion
31 lower joint portion
31*a* bent part
32 middle joint portion
32*a* middle hooked portion
32*b* bent part
33 upper joint portion
33*a* hooking portion
33*b* upper hooked portion
33*c* reinforcing rib
301 first internal-wall perpendicular portion
(axial-direction holding portion)
301*a* bent part
302 second internal-wall perpendicular portion
(axial-direction holding portion)
303 internal-wall horizontal portion
(thickness holding portion)
4, 5 packing
6 corner piece
7 joining body
71 first joining portion
72 second joining portion
73 main plane portion
74 perpendicular portion (end part)
75 horizontal portion (end part)
8 thickness holding member (thickness holding portion)
S heat insulating layer
T predetermined thickness

The invention claimed is:

1. A dew-condensation preventing square duct, comprising:

an external square duct formed by four plate-shaped external wall portions and having a substantially quadrilateral cross-sectional shape, wherein an end part of each external wall portion is formed with an external joint portion extending outward substantially perpendicularly to a plate surface of each of the four plate-shaped external wall portions;

an internal square duct formed by four plate-shaped internal wall portions, the internal square duct being receivable in the external square duct, wherein an end part of each internal wall portion is formed with an internal joint portion having a substantially quadrilateral cross-sectional shape, the internal wall portions extending substantially parallel to the plate surface of at least one of the four internal wall portions; and an internal-wall holding portion that retains the internal square duct inside of the external square duct such that a heat insulating layer of a predetermined thickness is formed between the external square duct and the internal square duct.

2. The dew-condensation preventing square duct according to claim 1, further comprising an axial-direction holding portion holding the internal square duct in a plurality of axial directions relative to the external square duct.

3. The dew-condensation preventing square duct according to claim 1, wherein a thickness holding portion is formed by protruding a part of at least one external wall portion toward a corresponding internal wall portion and bending the part such that the part comes into contact with the corresponding internal wall portion, or by protruding a part of at least one internal wall portion toward a corresponding external wall portion and bending the part such that the part comes into contact with the corresponding external wall portion.

4. The dew-condensation preventing square duct according to claim 1, wherein:

the internal joint portion includes a lower joint portion, a middle joint portion and an upper joint portion, the lower joint portion, the middle joint portion and the upper joint portion being formed by folding an end part of each internal wall portion so as to form three layers each extending in a planar direction substantially parallel to a planar direction of extension of a plate surface of the internal wall portion, and such that a free end of the upper joint portion protrudes at an angle relative to a direction of extension of the lower joint portion and the middle joint portion; and the internal square duct is connected to a connected body, the connected body including a second internal joint portion configured to include a similar structure to that of the internal joint portion of the internal square duct, by fittably receiving the upper joint portion of the internal joint portion of the internal square duct between an_upper joint portion and a middle joint portion of the second internal joint portion of the connected body, or by fitting the upper joint portion of the second internal joint portion of the connected body between the upper joint portion and the middle joint portion of the internal joint portion of the internal square duct.

5. The dew-condensation preventing square duct according to claim 4, wherein:

the upper joint portion of the second internal joint portion includes a hooking portion and an upper hooked portion, and the middle joint portion of the internal joint portion includes a middle hooked portion;

the upper joint portion of the internal joint portion of the internal square duct is fitted between the upper joint portion and the middle joint portion of the internal joint portion of the connected body, and thereby, the hooking portion of the internal square duct interoperates with the middle hooked portion of the connected body, and the hooking portion of the connected body interoperates with the upper hooked portion of the internal square duct; and the upper joint portion of the internal joint portion of the connected body is fittably receivable between the upper joint portion and the middle joint portion of the internal joint portion of the internal square duct, and thereby, the hooking portion of the connected body interoperates with the middle hooked portion of the internal square duct and the hooking portion of the internal square duct hooks the upper hooked portion of the connected body.

6. The dew-condensation preventing square duct according to claim 4, wherein:

the upper joint portion of the internal joint portion includes a reinforcing rib having a U-shape or a concave cross-sectional shape; and the upper joint portion of the internal joint portion of the internal square duct is fittably receivable between the upper joint portion and the middle joint portion of the internal joint portion of the connected body, or the upper joint portion of the internal joint portion of the connected body is fittably receivable between the upper joint portion and the middle joint portion of the internal joint portion of the internal square duct, and thereby, the reinforcing rib of the internal square duct and a reinforcing rib of the connected body overlap in at least one direction of extension with one another.

7. The dew-condensation preventing square duct according to claim 4, wherein an axial-direction holding portion is formed by a protruding portion of at least one of the external wall portions that extends toward and is bent in relation to a corresponding internal wall portion such that the axial-direction holding portion comes into contact with a bent portion of the upper joint portion and a bent portion of the middle joint portion of the internal joint portion.

8. The dew-condensation preventing square duct according to claim 4, wherein, when the internal square duct is connected to the connected body, a joining body is provided which joins a plurality of corner parts of each of the internal joint portions of the internal square duct with the connected body.

9. The dew-condensation preventing square duct according to claim 8, wherein:

the joining body has a substantially cross-sectionally L-shaped body and includes a first joining portion having a substantially cross-sectional C-shape and a second joining portion having a substantially cross-sectional C-shape, each of the first joining portion and the second joining portion extending in planar cross-sectional directions substantially perpendicular to one another and perpendicular to a direction of extension of at least one leg of the L-shaped body; and each of the plurality of corner parts of each of the internal joint portions is joined together via an edge of a first superposition portion formed by superposing a first one of the internal joint portions of the internal square duct and a first one of the internal joint portions of the connected body, wherein an end part of each first superposition portion inserts into the C-shape of the first joining portion and the second joining portion on a side of an end part of a second superposition portion formed by superposing on top of each other a second internal joint portion of the internal square duct and the second internal joint portion of the connected body, and then closing both end parts of the C-shape of the first joining portion and fitting the end part of the second superposition portion into the C-shape of the second joining portion.

10. The dew-condensation preventing square duct according to claim 1, wherein:

the end part of each of the external wall portions is formed with an external joint portion extending in a planar direction substantially perpendicular to a planar direction of extension of the plate surface of the external wall portion; and the end part of each of the internal wall portions is formed with an internal joint portion extending in a planar direction substantially perpendicular to a planar direction of extension of the plate surface of the internal wall portion and substantially parallel to a planar direction of extension of the external joint portion.

11. The dew-condensation preventing square duct according to claim 10, wherein:

the internal joint portion includes a first internal-wall perpendicular portion formed by bending an end part of the internal wall portion outward substantially perpendicular to the planar direction of extension to the plate surface of the internal wall portion, and an internal-wall horizontal portion formed by bending the end part of the internal wall portion substantially parallel to planar direction of extension to the plate surface; and the first internal-wall perpendicular portion is substantially in the same planar direction of extension as the external joint portion, and the internal-wall horizontal portion comes into contact with the external wall portion.

12. The dew-condensation preventing square duct according to claim 11, wherein:

the external joint portion includes a first external-wall perpendicular portion formed by bending an end part of the external wall portion outward substantially perpendicular to the planer direction of extension of the plate surface of the external wall portion, and a second external-wall perpendicular portion protruding outward from the first external-wall perpendicular portion on a free-end side of the first external-wall perpendicular portion;

the internal joint portion includes the first internal-wall perpendicular portion formed by bending an end part of the internal wall portion outward substantially perpendicular to the planar direction of the plate surface of the internal wall portion, a second internal-wall perpendicular portion formed by bending the end part of the internal wall portion such that the second internal-wall perpendicular portion is superposed on the first internal-wall perpendicular portion, and the internal-wall horizontal portion formed by bending the end part of the internal wall portion on a free-end side of the second internal-wall perpendicular portion substantially parallel to the planar direction of the plate surface of the internal wall portion; and the second internal-wall perpendicular portion faces the first external-wall perpendicular portion, the first internal-wall perpendicular portion is substantially in the same planar direction as the second external-wall perpendicular portion, and the internal-wall horizontal portion comes into contact with the external wall portion.

13. The dew-condensation preventing square duct according to claim 12, wherein the second internal-wall perpendicular portion comes into contact with the first external-wall perpendicular portion to function as an axial-direction holding portion holding the internal square duct in an axial direction thereof.

14. The dew-condensation preventing square duct according to claim 12, wherein:

the external joint portion includes a first external-wall perpendicular portion formed by bending the end part of the external wall portion outward substantially perpendicular to the planar direction of the plate surface of the external wall portion, and the second external-wall perpendicular portion protruding outward from the first external-wall perpendicular portion on a free-end side of the first external-wall perpendicular portion;

the internal joint portion includes an internal-wall horizontal portion formed by bending the end part of the internal wall portion such that the end part protrudes toward the planar direction of the plate surface of the internal wall portion, a first internal-wall perpendicular portion is formed by bending a free end part of the internal joint portion outward from the internal-wall horizontal portion and substantially perpendicularly to the plate surface of the internal wall portion, and a second internal-wall perpendicular portion is formed by bending the free end part of the internal joint portion such that the free end part is superposed on the first internal-wall perpendicular portion; and the second internal-wall perpendicular portion faces the first external-wall perpendicular portion, the first internal-wall perpendicular portion is substantially in the same plane as the second external-wall perpendicular portion, and the internal-wall horizontal portion comes into contact with the external wall portion.

15. The dew-condensation preventing square duct according to claim 14, wherein the second internal-wall perpendicular portion comes into contact with the first external-wall perpendicular portion to function as an axial-direction holding portion holding the internal square duct in an axial direction thereof.

* * * * *